US010357868B2

(12) United States Patent
Kawakami et al.

(10) Patent No.: US 10,357,868 B2
(45) Date of Patent: Jul. 23, 2019

(54) GRINDER, COVER, AND LOCK NUT

(71) Applicant: MAKITA CORPORATION, Anjo-shi (JP)

(72) Inventors: Takahiro Kawakami, Anjo (JP); Satoshi Ninagawa, Anjo (JP); Kenji Shibata, Anjo (JP); Ryosuke Otani, Anjo (JP); Ryo Imuta, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 173 days.

(21) Appl. No.: 15/257,987

(22) Filed: Sep. 7, 2016

(65) Prior Publication Data

US 2017/0072532 A1 Mar. 16, 2017

(30) Foreign Application Priority Data

Sep. 10, 2015 (JP) ..... 2015-178869

(51) Int. Cl.
*B24B 55/05* (2006.01)
*B24B 23/02* (2006.01)

(52) U.S. Cl.
CPC ..... *B24B 55/052* (2013.01); *B24B 23/02* (2013.01); *B24B 23/028* (2013.01)

(58) Field of Classification Search
CPC ..... B24B 23/02; B24B 23/028; B24B 55/05; B24B 55/052; B24B 55/055; B27G 19/02; B27G 19/04
USPC ..... 451/358, 359
See application file for complete search history.

(56) References Cited

U.S. PATENT DOCUMENTS

| | | | | |
|---|---|---|---|---|
| 2,152,352 | A * | 3/1939 | Holt | B24B 55/102 15/385 |
| 3,793,784 | A | 2/1974 | Jetzt | |
| 4,622,782 | A | 11/1986 | Roestenberg | |
| 5,125,190 | A * | 6/1992 | Buser | B24B 55/102 451/359 |
| 5,766,062 | A | 6/1998 | Edling | |
| 5,791,979 | A * | 8/1998 | Duncan | B24B 55/102 451/359 |
| 6,699,114 | B1 | 3/2004 | Booeshaghi et al. | |
| 10,035,240 | B2 * | 7/2018 | Buser | B24B 55/102 |
| 2006/0068690 | A1 | 3/2006 | Koschel et al. | |

(Continued)

FOREIGN PATENT DOCUMENTS

| | | | |
|---|---|---|---|
| CN | 101784370 | A | 7/2010 |
| DE | 29717099 | U1 | 12/1997 |

(Continued)

OTHER PUBLICATIONS

English machine tranlation of Rudolf, DE 102008022294 A1.*

(Continued)

*Primary Examiner* — Monica S Carter
*Assistant Examiner* — Marcel T Dion
(74) *Attorney, Agent, or Firm* — J-TEK Law PLLC; Jeffrey D. Tekanic; Scott T. Wakeman

(57) ABSTRACT

A grinder includes a motor, a housing, a spindle and a cover. The spindle protrudes downward from the housing, is driven by the motor, and thereby rotates. The cover is provided on the spindle in the circumferential direction and at least partially covers a tool accessory, which is mounted on the spindle. The cover is configured such that at least one part deforms and/or is composed of an elastic material.

19 Claims, 17 Drawing Sheets

(56) References Cited

U.S. PATENT DOCUMENTS

| | | | | |
|---|---|---|---|---|
| 2009/0029635 | A1 | 1/2009 | Boeck et al. | |
| 2009/0197515 | A1 | 8/2009 | Wang | |
| 2009/0229436 | A1 | 9/2009 | Crain et al. | |
| 2009/0266214 | A1 | 10/2009 | Boeck et al. | |
| 2010/0261417 | A1* | 10/2010 | O'Shannessy | B24B 23/005 451/344 |
| 2011/0092141 | A1* | 4/2011 | McCutchen | B24B 55/05 451/451 |
| 2011/0318999 | A1 | 12/2011 | Boeck et al. | |
| 2012/0037392 | A1 | 2/2012 | Ikuta et al. | |
| 2012/0190280 | A1 | 7/2012 | Esenwein | |
| 2014/0342645 | A1 | 11/2014 | Tagscherer | |
| 2015/0231756 | A1* | 8/2015 | Roeck | B24B 23/02 451/177 |
| 2017/0072533 | A1 | 3/2017 | Yoshizaki et al. | |
| 2017/0072534 | A1 | 3/2017 | Nakamura et al. | |
| 2017/0072535 | A1 | 3/2017 | Iwakami et al. | |

FOREIGN PATENT DOCUMENTS

| | | | | |
|---|---|---|---|---|
| DE | 10107290 | A1 | 9/2002 | |
| DE | 102007041840 | A1 | 5/2008 | |
| DE | 102007046311 | A1 | 4/2009 | |
| DE | 102008022294 | A1 * | 10/2009 | B24B 23/028 |
| DE | 102009028404 | A1 | 2/2011 | |
| DE | 102012207571 | A1 | 10/2013 | |
| EP | 0267993 | A1 | 5/1988 | |
| EP | 0812657 | A1 | 12/1997 | |
| EP | 1642680 | A1 | 4/2006 | |
| EP | 1952944 | A1 | 8/2008 | |
| EP | 2248629 | A1 | 11/2010 | |
| EP | 2205397 | B1 | 3/2012 | |
| GB | 940226 | A | 10/1963 | |
| GB | 2329440 | A | 3/1999 | |
| JP | S5633156 | B2 | 8/1981 | |
| JP | S5813952 | U | 1/1983 | |
| JP | S60142062 | U | 9/1985 | |
| JP | S63127873 | A | 5/1988 | |
| JP | H02122755 | U | 10/1990 | |
| JP | 2000176817 | A | 6/2000 | |
| JP | 2009000795 | A | 1/2009 | |
| JP | 2012061591 | A | 3/2012 | |
| JP | 2013078823 | A | 5/2013 | |
| JP | 2013116525 | A | 6/2013 | |
| JP | 2013226617 | A | 11/2013 | |
| WO | 2013161444 | A1 | 10/2013 | |

OTHER PUBLICATIONS

Extended European Search Report from the European Patent Office dated Feb. 20, 2017 in related EP application No. 16 187 688.3, including European Search Opinion, European Search Report, and examined claims 1-12.

Extended European Search Report from the European Patent Office dated Feb. 20, 2017 in related EP application No. 16 187 679.2, including European Search Opinion, European Search Report, and examined claims 1-15.

Extended European Search Report from the European Patent Office dated Feb. 21, 2017 in related EP application No. 16187 692.5 including European Search Opinion, European Search Report, and examined claims 1-14.

Extended European Search Report from the European Patent Office dated Jan. 31, 2017 in related EP application No. 16 187 675.0, including European Search Opinion, European Search Report, and examined claims 1-9.

U.S. Appl. No. 15/258,010, filed Sep. 7, 2016.

U.S. Appl. No. 15/258,045, filed Sep. 7, 2016.

U.S. Appl. No. 15/258,098, filed Sep. 7, 2016.

English summary of Japanese Utility Model Publication No. S56-33156 U.

English translation of Office Action from the Japanese Patent Office dispatched Mar. 19, 2019 in counterpart Japanese application No. 2015-178869.

Machine translation of Search Report from the Japanese Patent Office dated Mar. 8, 2019 in counterpart Japanese application No. 2015-178869.

Office Action from the Japanese Patent Office dated Mar. 19, 2019 in counterpart Japanese application No. 2015-178869, and machine translation thereof.

* cited by examiner

GRINDER, COVER, AND LOCK NUT

CROSS-REFERENCE

This application claims priority to Japanese patent application serial number 2015-178869, filed on Sep. 10, 2015, the contents of which are incorporated herein by reference in their entirety.

TECHNICAL FIELD

The present disclosure relates to a grinder.

BACKGROUND ART

Known grinders are capable of performing processing, such as grinding, polishing, cutting, or the like, on a workpiece. Such a grinder comprises a spindle that is rotationally driven by a drive device. Various tool accessories are detachably mountable on the spindle. A protective cover that covers the tool accessory from above is normally mounted on the grinder as shown, for example, in Japanese Laid-open Patent Publication No. 2013-78823.

SUMMARY

Nevertheless, if the surface area of the tool accessory covered by the protective cover is increased, work efficiency might decrease.

One aspect of the present disclosure is therefore to provide a grinder that achieves an improved balance of the benefits of increased covering of a tool accessory and the work efficiency of the tool accessory.

A grinder according to one aspect of the present disclosure comprises a motor, a housing, a spindle, and a cover. The housing houses the motor. The spindle protrudes downward from the housing, is driven by the motor, and thereby rotates. The cover at least partially covers the tool accessory mounted on the spindle. The cover is fixed to, for example, the housing.

According to another aspect of the present disclosure, the cover can be configured such that it at least partially encircles the spindle in the circumferential direction and at least partially covers the tool accessory, which is mounted on the spindle, from above. According to another aspect of the present disclosure, the cover is further configured such that at least one part of the cover can be resiliently deformed in a direction away from the tool accessory. According to this configuration, the cover is capable of deforming, and consequently it is possible to prevent problems that may be caused by a cover that is not capable of deforming.

For example, according to another aspect of the present disclosure, it is possible to prevent a decrease in work efficiency that might be caused by the cover interfering with a workpiece. Accordingly, it is possible to prevent a drop in work efficiency even if the surface area over which the cover covers the tool accessory is enlarged.

In another aspect of the present disclosure, at least one part of the cover may comprise or be composed of an elastic and/or resilient material. The cover can be configured such that at least part thereof can deform, due to the deformation of the elastic material, in a direction away from the tool accessory.

In another aspect of the present disclosure, the cover may be configured such that it deforms, by folding, in a direction away from the tool accessory. The cover can be configured such that a plurality of cover parts, which at least partially covers the tool accessory from above, is provided. For example, the plurality of cover parts may include a first cover part that is foldably connected to a second cover part, e.g., at a location that is farther spaced apart from the spindle in the radial direction than is the second cover part.

When a workpiece is being cut by the grinder, a side edge of the tool accessory rotates to cut the workpiece. In this case, the portion of the cover near the side edge of the tool accessory tends to adversely affect work efficiency. In addition, during processing work in which the grinder is not used for cutting, the need arises for various reasons to use the vicinity of the side edge of the tool accessory during the processing. Disposing the first cover part such that it can fold at a location spaced apart from the spindle in the radial direction makes it possible to prevent, for example, a drop in work efficiency caused by the cover part interfering with the workpiece during such processing work, the intended processing work from being hindered by interference, and the like.

In order to fold the first cover part, it may be connected to the second cover part via a hinge. Alternatively, a connection part that connects the first cover part and the second cover part, at least part of the first cover part, or at least part of the second cover part may be composed of an elastic and/or resilient material. By using a hinge, an elastic material, or some other resiliently deformable raw material, the cover can be configured such that it folds in a direction away from the tool accessory.

The cover may be configured such that a specific angular area along the circumferential direction deforms in the direction away from the tool accessory. This angular area is defined by an angle along the circumferential direction. The cover may have a circular shape or a doughnut shape that encircles the spindle in the circumferential direction, and may be configured such that a semicircular (180°) area thereof deforms in a direction away from the tool accessory. This deformation should occur at least partially in the specific angular area.

In another aspect of the present disclosure, a grinder may be provided that comprises: a motor; a housing; a spindle; and a cover that at least partially encircles the spindle in the circumferential direction and that at least partially covers the tool accessory mounted on the spindle. In such an embodiment, the cover is preferably at least partially composed of an elastic and/or resilient material that can be provided in order to, for example, deform, arrange, or adjust the cover.

In another aspect of the present disclosure, a grinder may be provided that comprises: a motor; a housing; a spindle; and a cover that at least partially encircles the spindle in the circumferential direction and at least partially covers the tool accessory, which is mounted on the spindle, from above. In such an embodiment, the cover preferably has a plurality of angular areas defined along the circumferential direction and each angular area is composed of a raw material that differs from the angular area adjacent thereto. At least one of the plurality of angular areas is composed of an elastic and/or resilient material.

The cover may be configured such that it has, as the above-mentioned plurality of angular areas, a semicircular area composed of an elastic material and a semicircular area composed of a metal material. In other words, in this aspect of the present disclosure, the cover comprising the semicircular area composed of an elastic material and the semicircular area composed of a metal material may be provided on the grinder. According to this cover, the area composed of an elastic material can be deformed in a direction away from the tool accessory. Deformation contributes to preventing a drop in work efficiency, a drop in processing performance, or the like caused by the cover interfering with the workpiece.

In another aspect of the present disclosure, a grinder may be provided that comprises: a motor; a housing; a spindle; a cover that at least partially encircles the spindle in the circumferential direction and at least partially covers the tool accessory, which is mounted on the spindle; and an elastic and/or resilient material that at least partially encircles the surface of the cover that faces the tool accessory. The cover may be configured such that the tool accessory is at least partially covered from above and the side. According to the cover composed of this elastic material, impacts that occur when debris from the workpiece, the tool accessory, or the like flies about inside the cover during processing work can be absorbed by the elastic material. The elastic material can be affixed to the surface of the cover that faces the tool accessory.

In another aspect of the present disclosure, a grinder may be provided that comprises: a motor; a housing; a spindle; and a cover that at least partially encircles the spindle in the circumferential direction and at least partially covers the tool accessory, which is mounted on the spindle, from above and below. In this grinder, the cover may be composed of an elastic and/or resilient material. The cover can be configured such that at least a portion of the cover that covers the tool accessory from below is elastically and/or resiliently deformable in a direction downward from and away from the tool accessory.

According to another aspect of the present disclosure, the cover may comprise: a first cover part that at least partially encircles the spindle in the circumferential direction and at least partially covers the tool accessory from above; and a second cover part that is fixed to the first cover part and at least partially covers the tool accessory from below. The second cover part can be at least partially composed of an elastic and/or resilient material. Because of this elastic material, the cover can be configured such that at least a portion of the cover is elastically and/or resiliently deformable in a direction downward and away from the tool accessory.

Covering the tool accessory with a cover from below in addition to above helps prevent the scattering of dust. Nevertheless, adequate space is usually needed below the spindle in order to allow tool accessories to be changed. Accordingly, an inflexible cover that at least partially covers the tool accessory from below might interfere with or even prevent the tool accessory from being changed (exchanged or replaced).

According to another aspect of the present disclosure, because the elastic material that constitutes the cover is deformable, the space below the spindle needed to perform the work of exchanging the tool accessory can be enlarged, and interference between the cover and the tool accessory during the exchange can be prevented. Accordingly, it is possible to provide a highly convenient grinder while preventing the scattering of dust.

According to another aspect of the present disclosure, a grinder may be provided in which a cover comprises: a first cover part that at least partially encircles the spindle in the circumferential direction and at least partially covers the tool accessory from above; and a second cover part that is fixed to the first cover part and at least partially covers the tool accessory from below. At least one part of the second cover part is preferably configured such that the user's view is not blocked.

During certain processing work, it is possible that the second cover part will be interposed between the portion of the workpiece to be processed and the user's eyes. If the second cover part is configured such that it does not partially or completely block the user's view, then it is possible to prevent the second cover part from having an undesirable effect on work efficiency.

The second cover part may have a through hole so that the user's view is not completely blocked. The second cover part may be at least partially composed of a mesh material. The second cover part may be at least partially composed of a transparent material. "Transparent" herein includes semi-transparent. According to such a configuration, it is possible to provide a grinder that is capable of achieving high work efficiency.

According to another aspect of the present disclosure, a grinder may be provided that comprises: a motor; a housing; a spindle; an inner flange that is provided on a tip part of the spindle; a lock nut that is disposed downward of the inner flange and separated therefrom by a tool accessory, the lock nut fixing the tool accessory between the lock nut and the inner flange; and a cover for grinding that at least partially encircles the spindle in the circumferential direction and that at least partially covers the tool accessory, which is mounted on the spindle, from above. In this grinder, the lock nut can be configured such that it has, on both surfaces, a boss or pilot part that forms, between the inner flange and the lock nut, a space that corresponds to the thickness of the tool accessory for grinding. The protruding pilot part faces the inner flange when the lock nut is mounted on the spindle.

A tool accessory for cutting is usually thinner than a tool accessory for grinding. Consequently, according to the configuration of the above-mentioned lock nut, it is possible to make it difficult to fix the tool accessory for cutting to the spindle using the same lock nut for affixing a grinding tool to the spindle. The cover for grinding can be, for example, a cover in which the surface area that covers the tool accessory is smaller than that of the cover for cutting. The cover for grinding can be, for example, a cover configured such that the tool accessory is essentially not covered from below.

In addition, according to another aspect of the present disclosure, the cover described above, which is mounted on the grinder, may be provided. According to another aspect of the present disclosure, a cover may be provided that comprises: a cover part, which at least partially covers the tool accessory; and a fixing part, which is for fixing the cover part. Such a cover part preferably has one or more of the features described above. The fixing part can be configured such that the cover part is fixed to the housing, which constitutes the grinder.

According to another aspect of the present disclosure, a cover may be provided that is configured to at least partially encircle a spindle, which constitutes a grinder and protrudes downward, in a circumferential direction. The cover preferably at least partially covers a tool accessory, which is mounted on the spindle, from above. A structure is preferably provided in which at least part of the cover is deformable in a direction away from the tool accessory. The cover can be configured such that it comprises the cover part, which at least partially covers the tool accessory from above, and the fixing part, which is for fixing the cover part. Furthermore, the cover part can be configured such that at least part of the cover is deformable in a direction away from the tool accessory.

According to another aspect of the present disclosure, a cover may be provided that is configured to at least partially encircle the spindle of a grinder in a circumferential direction. The cover also preferably at least partially covers a tool accessory, which is mounted on the spindle, from above, and comprises an elastic and/or resilient material. The cover is preferably configured such that at least part thereof is elastically and/or resiliently deformable in a direction away from the tool accessory. According to another aspect of the present disclosure, the cover comprises the cover part and the fixing part; the cover part is at least partially composed of an elastic material, and at least part of the cover is configured to deform in a direction away from the tool accessory.

According to another aspect of the present disclosure, a cover may be provided that is configured to at least partially encircle the spindle of a grinder in the circumferential direction, and at least partially covers the tool accessory, which is mounted on the spindle, from above. The cover preferably has a structure in which at least part of the cover is configured to deform by folding in a direction away from the tool accessory. Such a cover preferably comprises a plurality of cover parts and can be configured such that a first cover part is foldably connected to a second cover part.

According to another aspect of the present disclosure, a cover may be provided that is configured to at least partially encircle a spindle of a grinder in a circumferential direction and at least partially covers a tool accessory, which is mounted on the spindle. The cover is preferably at least partially formed of an elastic or resilient material.

According to another aspect of the present disclosure, a cover may be provided that is configured to at least partially encircle a spindle of a grinder in a circumferential direction and at least partially covers a tool accessory, which is mounted on the spindle, from above. The cover preferably comprises a plurality of angular areas along the circumferential direction and each angular area is composed of a raw material different from that of its adjacent area. At least one of the plurality of angular areas is preferably composed of an elastic and/or resilient material.

According to another aspect of the present disclosure, a cover may be provided that is configured to at least partially encircle a spindle of a grinder in a circumferential direction and at least partially covers the tool accessory, which is mounted on the spindle, from above. Such a cover preferably has a semicircular area that is composed of an elastic and/or resilient material and a semicircular area that is composed of a metal or other inelastic, durable material.

According to another aspect of the present disclosure, a cover may be provided that is configured to at least partially encircle a spindle of a grinder in a circumferential direction and at least partially covers a tool accessory, which is mounted on the spindle. Such a cover preferably comprises an elastic and/or resilient material that covers at least part of a surface of the cover that faces the tool accessory.

According to another aspect of the present disclosure, a cover may be provided that is configured to at least partially encircle a spindle of a grinder in a circumferential direction and at least partially covers a tool accessory, which is mounted on the spindle, from above and below. Such a cover preferably comprises an elastic and/or resilient material. At least a portion of the cover that covers the tool accessory from below is elastically and/or resiliently deformable in a direction downward and away from the tool accessory.

According to another aspect of the present disclosure, a cover may be provided that is configured to at least partially encircle a spindle of a grinder in a circumferential direction and at least partially covers a tool accessory, which is mounted on the spindle. Such a cover preferably comprises a first cover part that at least partially encircles the spindle in the circumferential direction and at least partially covers the tool accessory from above; and a second cover part that is fixed to the first cover part and at least partially covers the tool accessory from below. For example, at least one part of the second cover part can be composed of an elastic and/or resilient material. As a separate or alternative example, at least one part of the second cover part may be configured such that a user's view below the tool accessory is not blocked. At least one part of the second cover part can be composed of a transparent material or a mesh material.

According to another aspect of the present disclosure, a lock nut may be provided that is fixed to a tip part of a spindle of a grinder and fixes the tool accessory between the lock nut and the inner flange of the spindle. The lock nut can be configured such that it has, on both surfaces, a boss or pilot part that forms, between the inner flange and the lock nut, a space that corresponds to the thickness of the tool accessory for grinding. The protruding pilot part faces the inner flange when the lock nut is mounted on the spindle.

DETAILED DESCRIPTION OF EMBODIMENTS

Figure 1:
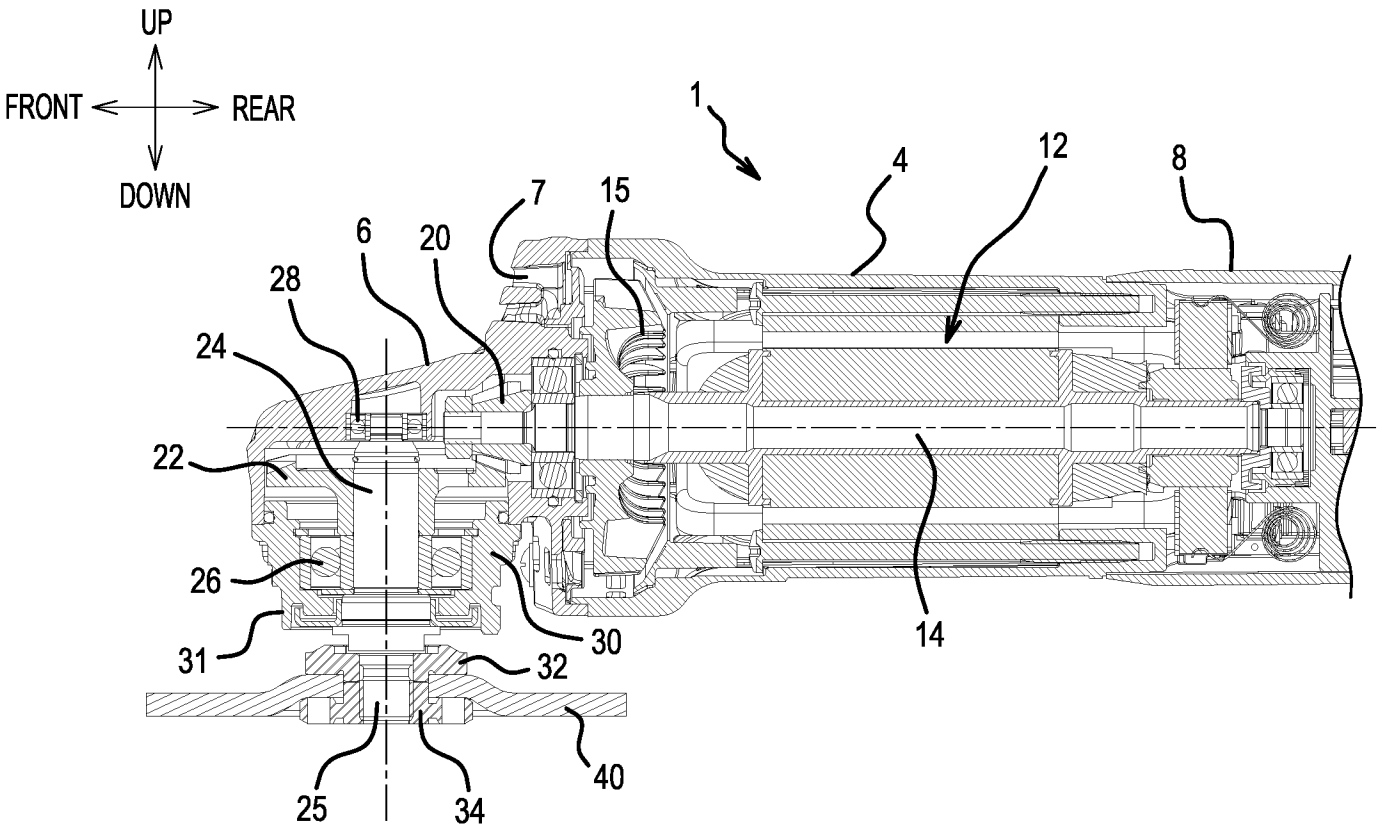
FIG.1 (PRIOR ART)
FIG. 1 is a cross-sectional view that shows the internal configuration of a grinder.

Representative, non-limiting embodiments of the present disclosure are explained below, with reference to the drawings.

Basic Configuration

First, the internal configuration of a basic grinder 1 will be explained. The grinder 1 is a so-called disc grinder to which a discoidal (disk-shaped) tool accessory 40 is attached. The grinder 1 performs processing on a workpiece 50 (refer to FIG. 3) by rotating the tool accessory 40. The tool accessory 40 may be selected from a variety of grinding wheels, such as a cutting stone, a grinding stone, etc., or a wire brush. The grinder 1 is configured such that the tool accessories are interchangeable.

Grinders 100, 200, 300, 400, 500 according to a first embodiment to a fifth embodiment will be explained following the explanation of the grinder 1, and are each configured such that, in each embodiment, a protective cover according to the present disclosure is attached to the grinder 1 shown in FIG. 1 or to a similar grinder. A grinder 600 according to a sixth embodiment is the grinder 1 shown in FIG. 1 or a similar grinder modified by the addition of a lock nut. A seventh embodiment explains a configuration of a tool accessory 40 according to the present disclosure that is attached to the grinder 1 or to a similar grinder.

In the embodiments disclosed and explained herein, a front-rear direction is defined along an axis line of an elongate grinder main body or along a corresponding rotary shaft 14 of a motor 12. Specifically, the side on which a spindle 24 is provided on the grinder main body is defined as the "front"; the opposite side is defined as the "rear", as shown in the coordinate system identified in FIG. 1.

In addition, an up-down direction is defined based on an axis line of the spindle 24. Specifically, the side on which the spindle 24 is housed in a first gear housing 6 and a second gear housing 30 is defined as "up," and the side on which the tool accessory 40 is mounted on the spindle 24 is defined as "down." In addition, a surface that extends in the up-down direction is defined as a "side surface" and thus utilizes a term related to direction.

The grinder 1 shown in FIG. 1 comprises a motor housing 4, the first gear housing 6, and a rear cover 8. The grinder 1 further comprises a second gear housing 30. The internal elements that constitute the grinder 1 are housed in an internal space of the grinder main body, which is principally formed by the motor housing 4, the first gear housing 6, the second gear housing 30, and the rear cover 8.

The motor housing 4 is a substantially circular-cylindrical housing and houses the motor 12. The rotary shaft 14 of the motor 12 is disposed such that it protrudes toward the adjacent first gear housing 6. The rear cover 8 is provided rearward of the motor housing 4 and houses electronic circuitry for supplying drive current to the motor 12 in order to drive the motor 12. The circuitry is supplied with external electric power via a power-supply cord 18 (refer to FIG. 3, etc.), which is not shown in FIG. 1. The drive of the grinder 1 is turned ON and OFF by a user operating a switch-operation unit 19 (not shown in FIG. 1) that is provided such that it is externally exposed.

The first gear housing 6 is provided forward of the motor housing 4 and houses a first bevel gear 20, a second bevel gear 22, a spindle 24, and bearings 26, 28.

The first bevel gear 20 is fixed to the rotary shaft 14 of the motor 12 inside the first gear housing 6. The second bevel gear 22 and the spindle 24 are rotatably provided in the second gear housing 30, which is configured as a structure separate from the first gear housing 6, via the bearing 26. The second bevel gear 22 and an upper part of the spindle 24 are housed inside the first gear housing 6, and the second gear housing 30 is fixed to the first gear housing 6.

The second gear housing 30 is fixed to the first gear housing 6 such that the spindle 24 is orthogonal to the rotary shaft 14 of the motor 12. The second gear housing 30 is, for example, screw-fastened to the first gear housing 6.

The second bevel gear 22 is fixed to the spindle 24. The second bevel gear 22 meshes with the first bevel gear 20 inside the first gear housing 6, and the rotational output of the motor 12 is thereby converted into a rotational force around the axis of the spindle 24.

One end of the spindle 24 is rotatably supported by the first gear housing 6 via the bearing 28, and the other end of the spindle 24 protrudes downward from the second gear housing 30.

An inner flange 32 for positioning and fixing the discoidal tool accessory 40 is provided on the portion of the spindle 24 that protrudes from the second gear housing 30. A screw part 25, onto which a lock nut 34 is screwed, is formed on an outer-circumferential portion of the spindle 24 that is closer to the tip than is the inner flange 32. The lock nut 34 is fixed to a lower end of the spindle 24 by screw-fastening, and the tool accessory 40 is sandwiched and fixed between the lock nut 34 and the inner flange 32.

In the grinder 1 configured in this manner, when the user turns the grinder 1 ON using the switch-operation unit 19, the motor 12 rotates, and the rotational output thereof is transmitted to the spindle 24 via a gear mechanism (the bevel gears 20, 22) inside the first gear housing 6. That is, the spindle 24 is rotationally driven by a drive device that includes the motor 12 and the gear mechanism housed in the housings 4, 6, 30.

Consequently, when the tool accessory 40 is fixed to the spindle 24 using the lock nut 34, the tool accessory 40 rotates in accordance with the rotation of the spindle 24. The grinder 1 performs processing, such as grinding, polishing, cutting, or the like, on the workpiece 50 by rotating the tool accessory 40. Of course, the type of processing work depends on the type of the tool accessory 40 mounted on the spindle 24.

A fan 15, which draws in outside air from an inlet hole of the rear cover 8 and exhausts air via an exhaust hole 7 provided in the first gear housing 6, is provided on the rotary shaft 14 of the motor 12.

Figure 2:
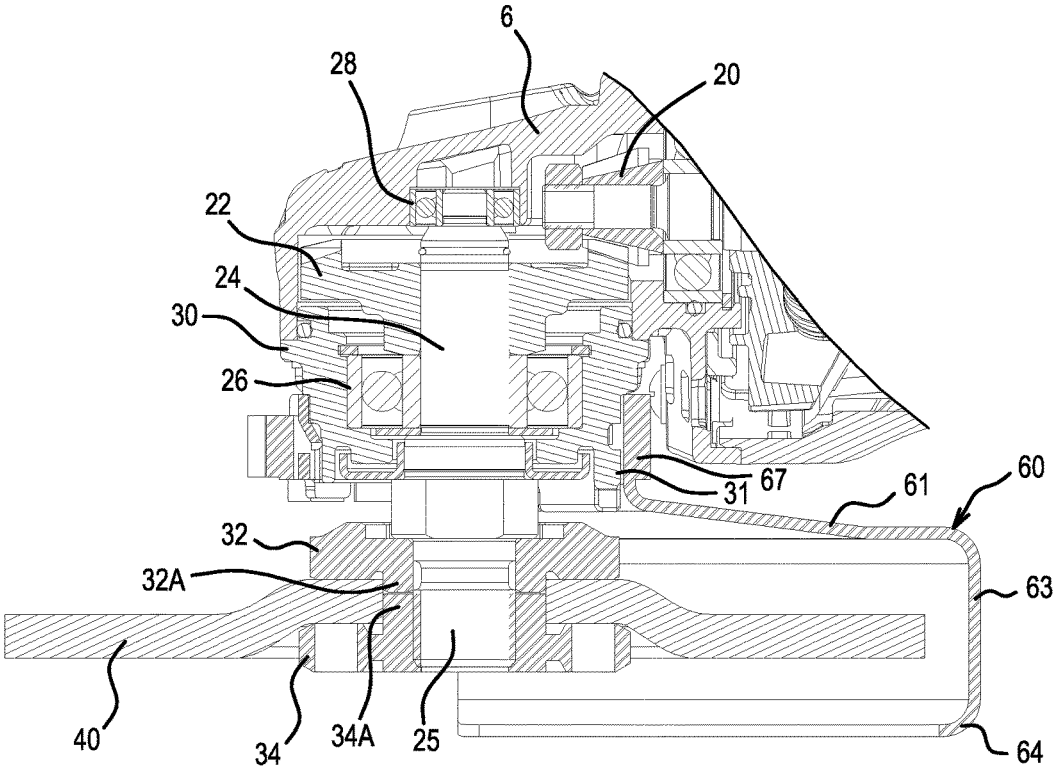
FIG.2 (PRIOR ART)
FIG. 2 is a cross-sectional view that shows the configuration surrounding a spindle with a conventional protective cover mounted on the grinder.

A protective cover 60, which covers the discoidal (disc-shaped or wheel-shaped) tool accessory 40, is further provided on the grinder 1 (refer to FIG. 2). The protective cover 60 is also known as a wheel cover or a disc cover in the power tool field. The phrase "to cover" in the present specification means to at least partially cover an object and, unless otherwise specially mentioned, is not limited to covering the entirety of the object.

FIG. 2 shows a cross-sectional configuration of the periphery of the spindle 24 and the tool accessory 40 with the conventional protective cover 60 mounted on the grinder 1 shown in FIG. 1.

The protective cover 60 shown in FIG. 2 comprises: a semicircular upper-part structure 61 for covering a rearward semicircular portion of an upper part of the discoidal tool accessory 40; and a side-part structure 63, which extends downward from an outer-circumferential-end edge of the upper-part structure 61. The protective cover 60 is configured by integrally forming the upper-part structure 61 and the side-part structure 63. For example, the upper-part structure 61 and the side-part structure 63 are integrally formed of a metal material. A curved part 64 is provided at the lower end of the side-part structure 63 and thereby the side-part structure 63 is slightly curved at the lower end on the inner side in the radial direction.

The protective cover 60 further comprises a circular-tubular part 67 for fixing the protective cover 60 to the second gear housing 30. The circular-tubular part 67 is provided on the upper-part structure 61 and serves as a circular-tubular part that is concentric with an outer-circumferential arc of the upper-part structure 61. The circular-tubular part 67 is designed such that its inner diameter is slightly larger than the outer diameter of a cover-connection part 31, which is provided on the second gear housing 30 and has a circular side surface.

Figure 5:
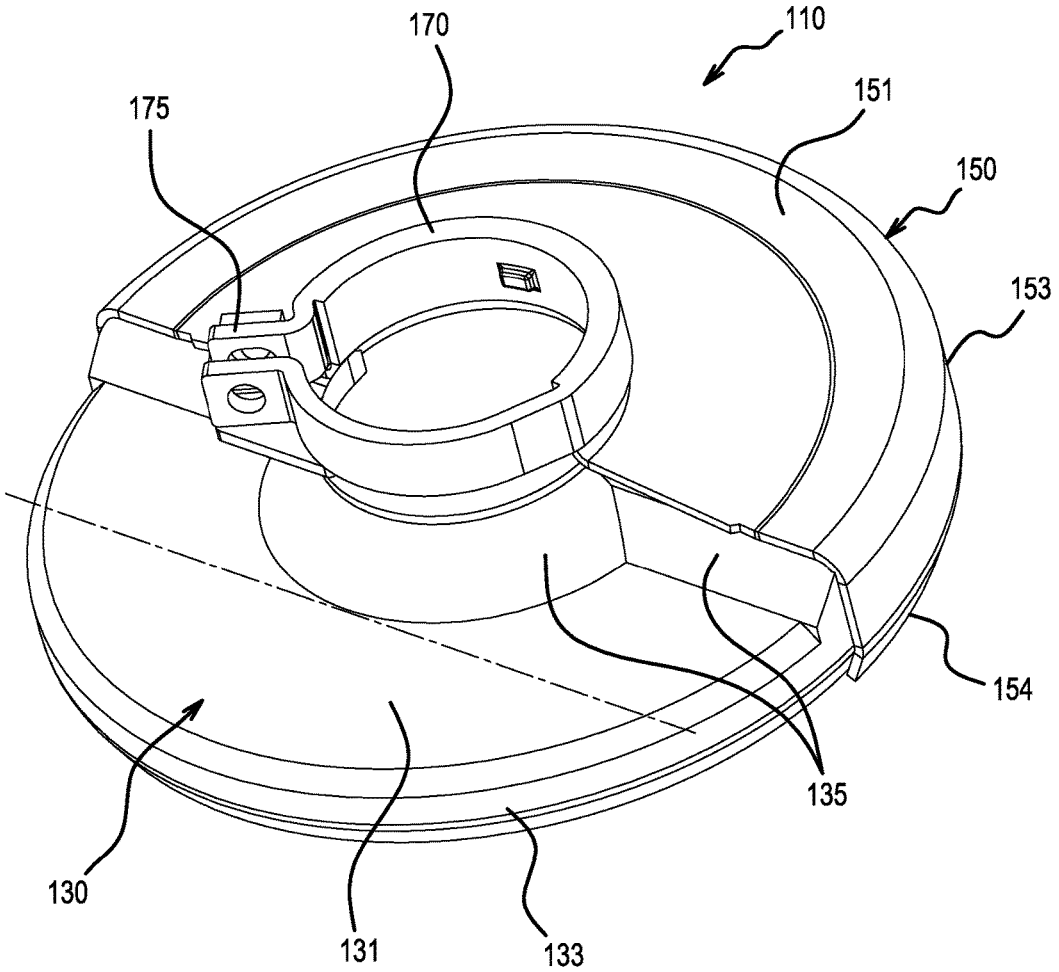
FIG. 5 is an oblique view of the protective cover according to the first embodiment.

Although not shown in FIG. 2, the circular-tubular part 67 is configured such that a section along a plane perpendicular to the up-down direction describes an open-ring shape, and the portion of the circular-tubular part 67 that is open in the circumferential direction is provided with a tightening part for tightening the circular-tubular part 67 to the cover-connection part 31 of the second gear housing 30 on the inner side in the radial direction. A circular-tubular part 170 and a tightening part 175, which have the same or corresponding configurations, are shown in FIG. 5.

The tightening part 175 functions such that, by changing the positional relationship between a screw and a nut, which sandwich the tightening part 175 on both sides, an inner side of the circular-tubular part 67 is tightened onto the cover-connection part 31 of the second gear housing 30, and thereby the protective cover 60 is fixed to the second gear housing 30. The protective cover 60 shown in FIG. 2 is used when processing the workpiece 50 by using, for example, a grinding stone.

In addition, the protective cover 60 can be attached to the cover-connection part 31 at an arbitrary angle (orientation) in the circumferential direction. The arrangement shown in FIG. 2 is a common arrangement used in grinding. The protective covers described in each embodiment below likewise can be attached to the grinder at an arbitrary angle. Accordingly, when explaining front, rear, left, and right in relation to the structural elements of the protective cover, the explanations are merely of the directions based on the common arrangement when performing grinding, and it should be understood that the orientation of the circumferential direction of the protective cover with respect to the grinder is not limited to any specific direction.

First Embodiment

The grinder 100 according to a first embodiment is configured by mounting a protective cover 110, which is shown in FIG. 3, FIGS. 4A, 4B, and FIG. 5, on the grinder 1 shown in FIG. 1 or a similar grinder. The protective cover 110 comprises: a forward-cover part 130 and a rearward-cover part 150, which are for covering the tool accessory 40 from above and extend in the circumferential direction of the spindle 24; and the circular-tubular part 170, which is for fixing the protective cover 110 to the second gear housing 30.

The forward-cover part 130 is composed of a resiliently elastic material, such as rubber or a rubber-like material. The rearward-cover part 150 is composed of a metal material. The circular-tubular part 170 is provided on the rearward-cover part 150 and is composed of a metal material.

As used herein, the term "elastic" refers to materials that are capable of changing shape (being deformed) in response to the application of a force and at least substantially (preferably, completely) returning to their original shape after the force is removed. While all materials have some degree of elasticity, as used herein, "elastic" preferably refers to materials that have a Young's modulus of less than about 0.5 GPa, e.g., less than about 0.2 GPa, e.g., less than about 0.05 GPa. Natural rubber (Young's modulus: approximately 0.002 GPa) is a representative, non-limiting example of such an elastic material. If the front cover section 130 is formed of an "elastic" material according to the present disclosure, it can be shifted from the position shown in FIG. 4A to the position shown in FIG. 3 by a user holding the grinder 100 and applying a relatively small amount of force against the side-part structure 133, e.g., by applying less than 4 kilograms of force, or e.g., less than about 1 kilogram of force.

Figure 3:
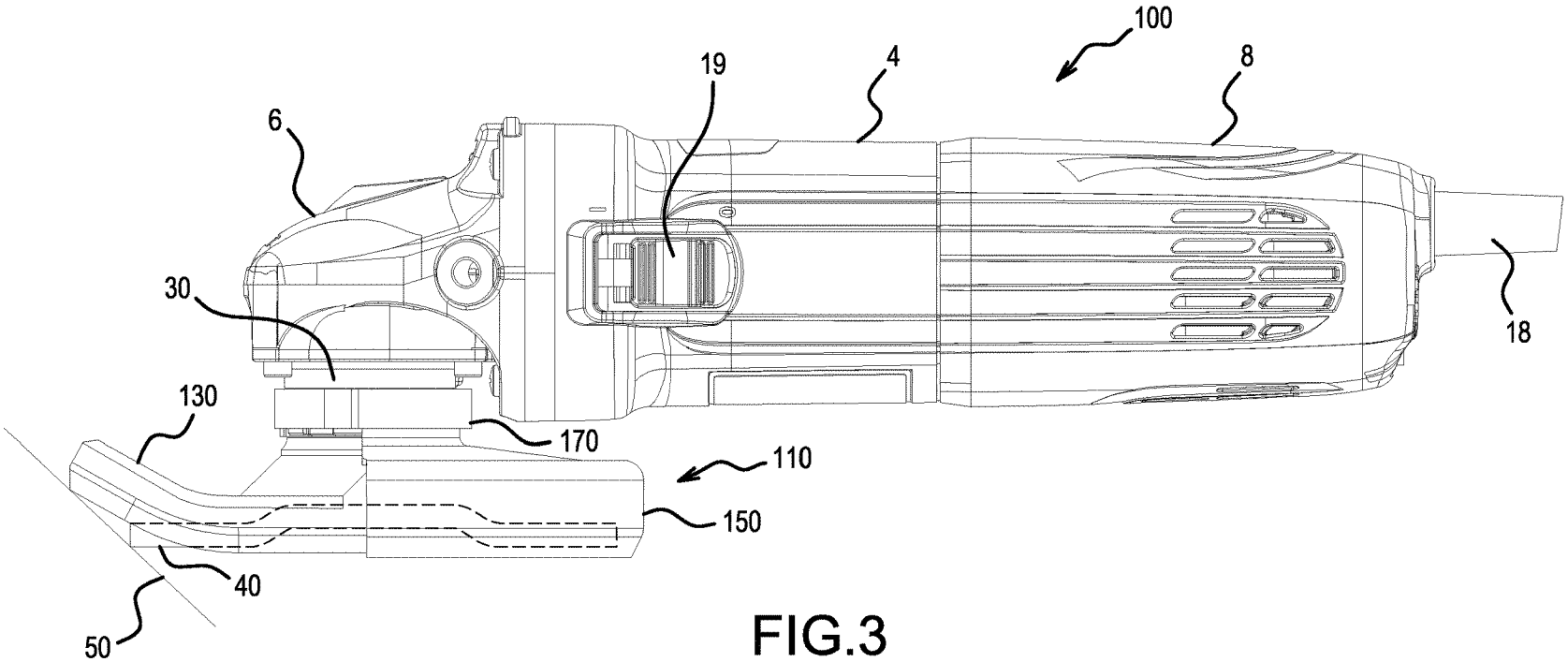
FIG. 3 is a side view of the grinder according to a first embodiment.

Because the forward-cover part 130 is composed of a resiliently elastic material, a forward portion of the protective cover 110 is deformable in the direction (on the upward side) away from the tool accessory 40 mounted on the spindle 24. The protective cover 110 in FIG. 3 is shown in a state in which it has been deformed from its normal state shown in FIG. 4A. In other words, the forward-cover part 130 has been deformed due to the application of a force from below.

According to FIG. 3, the forward-cover part 130 has received a counteracting force from the workpiece 50 and thereby has deformed upward. Owing to this deformation, a forward-side-edge part of the tool accessory 40 is revealed from the forward-cover part 130, and the user can perform processing work, using the side edge of the tool accessory 40 or areas radially inwardly of the side edge of the tool accessory 50 on the lower face of the tool accessory 40, without much interference between the workpiece 50 and the protective cover 110. The deformation can occur by flexing along at least two different flexing lines due to the resiliently elastic material.

Figure 4A:
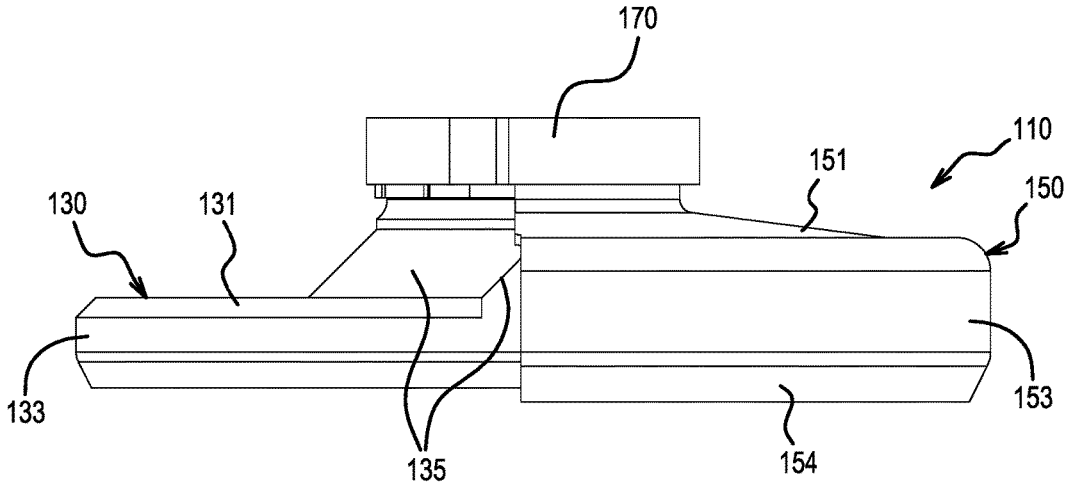
FIG. 4A is a side view of the protective cover according to the first embodiment.
Figure 4B:
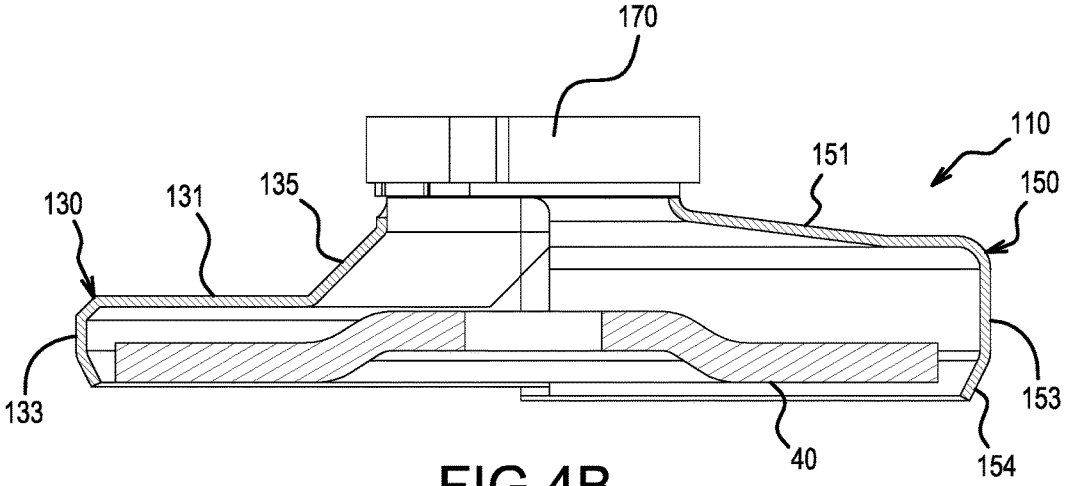
FIG. 4B is a partial cross-sectional view of the protective cover.

The dotted line in FIG. 3 indicates the contour of the tool accessory 40, which is housed within the protective cover 110 and is not externally visible from the side when the cover 110 is not deformed. As can be understood by comparing FIG. 3 with FIGS. 4A and 4B, when the protective cover 110 is not deformed, the tool accessory 40 is enveloped (surrounded) from above and the front by the protective cover 110; and when the protective cover 110 is deformed, the tool accessory 40 is partially revealed. It is noted that FIG. 4B shows a side view of the circular-tubular part 170 and shows a cross-sectional view of the configuration below the circular-tubular part 170.

As shown in FIG. 5, the forward-cover part 130 and the rearward-cover part 150, which constitute the protective cover 110, each have a semicircular shape. The rearward-cover part 150 and the circular-tubular part 170 basically have the same configuration as the conventional protective cover 60 shown in FIG. 2.

That is, the rearward-cover part 150 comprises: a semicircular upper-part structure 151 for covering the rearward semicircular portion of the upper part of the tool accessory 40; and a side-part structure 153 that extends downward from an outer-circumferential-end edge of the upper-part structure 151. The upper-part structure 151 and the side-part structure 153 are integrally formed of a metal material. As shown in FIG. 4B, the side-part structure 153 comprises a curved part 154 that faces radially inwardly (toward the axis-line of the spindle 24) at the lower end.

The circular-tubular part 170 is provided on the upper-part structure 151, which serves as a circular-tubular part that is concentric with an arc of the upper-part structure 151. On a portion of the circular-tubular part 170 that is open in the circumferential direction, a tightening part 175 is provided for tightening the circular-tubular part 170 onto the cover-connection part 31 of the second gear housing 30. The upper-part structure 151 has an extended portion that extends upward at a location corresponding to the circular-tubular part 170 and is connected to the circular-tubular part 170 at the extended portion. The circular-tubular part 170 is integrally configured with the extended portion or is configured as a structure separate from the extended portion.

The tightening part 175 is configured such that, by changing the positional relationship between a screw and a nut that sandwich the tightening part 175 on both sides, an inner side of the circular-tubular part 170 is tightened to the cover-connection part 31 of the second gear housing 30. Owing to the function of the circular-tubular part 170, the protective cover 110 is fixed to the second gear housing 30. After the protective cover 110 is fitted onto the cover-connection part 31 of the second gear housing 30, the protective cover 110 is fixed to the cover-connection part 31 by being tightened thereto.

Moreover, the forward-cover part 130 comprises: a semicircular upper-part structure 131 for covering the forward semicircular portion of the upper part of the tool accessory 40; and a side-part structure 133, which extends downward from an outer-circumferential-end edge of the upper-part structure 131. The upper-part structure 131 and the side-part structure 133 are integrally formed of rubber or a rubber-like material, e.g., an elastomeric material.

The upper-part structure 131 and the side-part structure 133 have a connection part (not shown) that overlaps an inner surface of the rearward-cover part 150, and this connection part is fixed to an inner surface of the rearward-cover part 150. For example, the upper-part structure 131 and the side-part structure 133 are fixed to the rearward-cover part 150 by an adhesive.

As can be understood also from FIG. 5, the upper-part structure 131 has angled wall portions or slopes 135 at the periphery of the connection part that connects to the rearward-cover part 150. Owing to the slopes 135, the majority of an upper surface of the upper-part structure 131 is disposed at a location lower than an upper surface of the rearward-cover part 150. A portion of each slope 135 is composed of a thick rubber material, and the forward-cover part 130 is configured such that it is easily folded from or at locations near the lower ends of the slopes 135. The lower end of the side-part structure 133 is disposed at a location higher than the lower end of the curved part 154.

Based on the explanation above, it can be understood that the protective cover 110 has the following characteristics. A first characteristic is that the protective cover 110 can partially deform (elastically and/or resiliently deform) away from the tool accessory 40. A second characteristic is that the protective cover 110 can deform by folding upward and away from the tool accessory 40.

Based on these characteristics, the protective cover 110 can prevent an adverse impact on work efficiency due to interference between the protective cover 110 and the workpiece 50 while still covering a large surface area of the tool accessory 40.

When the workpiece 50 is to be cut by the grinder 100, the side edge of the tool accessory 40 is generally used. On the other hand, when the workpiece 50 is to be ground or polished, the workpiece 50 may be processed using the flat bottom surface of the tool accessory 40—depending on the shape of the workpiece 50, the surrounding circumstances, the processing method, and the like.

Accordingly, by making the forward-cover part 130 foldable at a location spaced apart from the spindle 24 in the radial direction, in other words, at a location near the side edge of the tool accessory 40, it is possible to prevent the protective cover 110 from interfering with the workpiece 50 during processing work, and thereby to prevent any hindrance to the processing work due to interference.

When viewed from yet another aspect, it can be understood that the protective cover 110 is configured such that a specific angular area along the circumferential direction (the rotational direction of the spindle 24) deforms in a direction away from the tool accessory 40. According to the present embodiment, it can be understood that the forward semicircular (180°) area of the protective cover 110 is configured such that it deforms in the direction away from the tool accessory 40.

The angular range of deformability can be set taking work efficiency into account. Accordingly, the forward-cover part 130 may be configured to be deformable over an area narrower than 180°. For example, the protective cover 110 may be configured such that the boundary between the forward-cover part 130 and the rearward-cover part 150 lies along the chain line shown in FIG. 5. In the present embodiment, a rubber material is used in order to make the protective cover 110 deformable, but other elastic and/or resilient materials may be used, and a movable member, such as a hinge, may alternately be used as described below.

Second Embodiment

Figure 6:
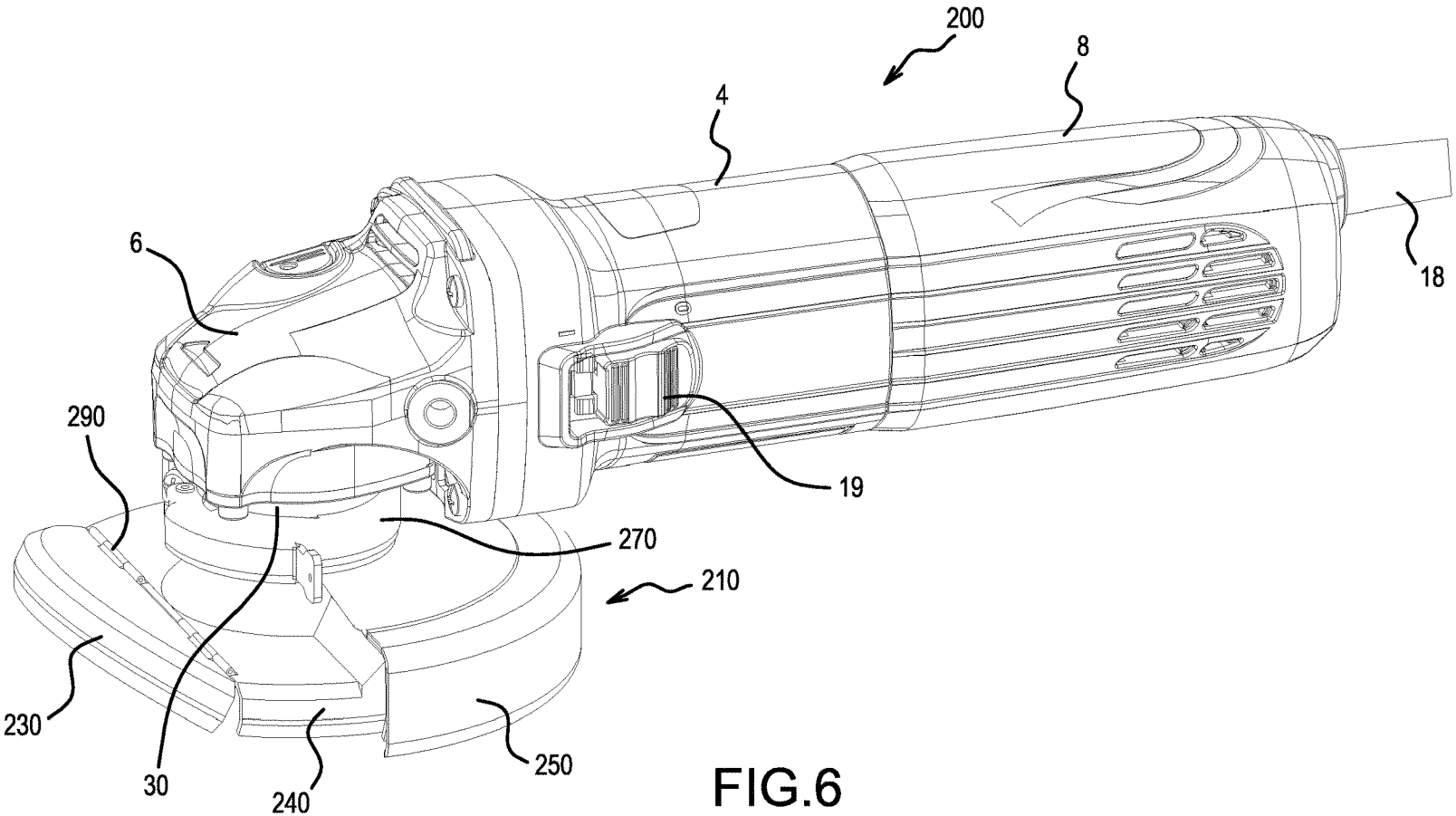
FIG. 6 is an oblique view of the grinder according to a second embodiment.
Figure 7:
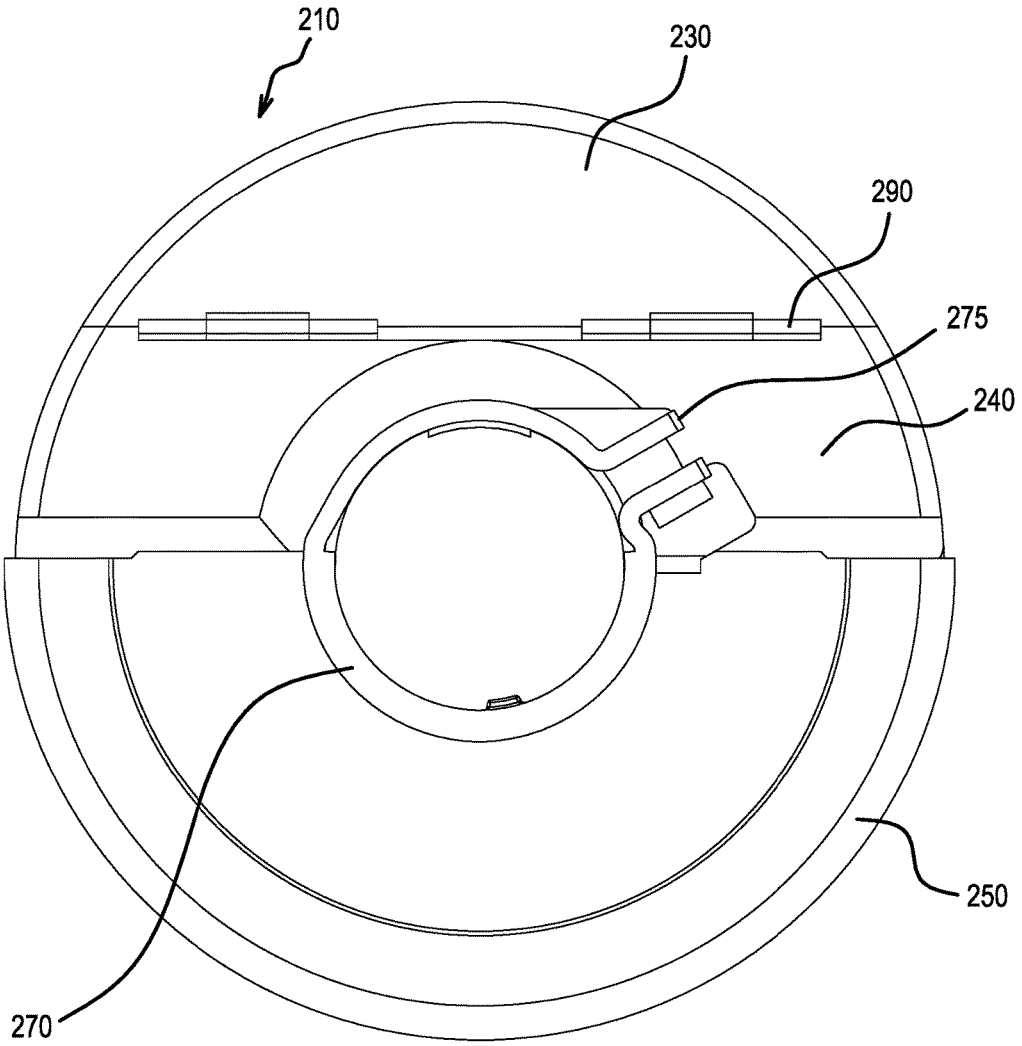
FIG. 7 is a top view of the protective cover according to the second embodiment.

The grinder 200 according to a second embodiment is configured by mounting a protective cover 210, which is shown in FIG. 6 and FIG. 7, on the grinder 1 shown in FIG. 1 or on a similar grinder.

The protective cover 210 comprises a forward-cover part 230, an intermediate-cover part 240, a rearward-cover part 250, and a circular-tubular part 270 for fixing the protective cover 210 onto the second gear housing 30. The rearward-cover part 250 and the circular-tubular part 270 are configured the same as the rearward-cover part 150 and the circular-tubular part 170 that constitute the protective cover 110 according to the first embodiment.

In the protective cover 210, the forward-cover part 130 that constitutes the protective cover 110 of the first embodiment is replaced by the forward-cover part 230 and the intermediate-cover part 240. However, in this embodiment, the forward-cover part 230 and the intermediate-cover part 240 are composed of a metal (rigid) material, which may be the same as or different from the rearward-cover part 250. In some embodiments, the metal (rigid) material may be replaced with hard, durable plastics that are not "elastic" in accordance with the present teachings.

The forward-cover part 230 and the intermediate-cover part 240 are connected by a hinge 290. The hinge 290 holds the forward-cover part 230 so that it can pivot around an axis along the left-right direction, which is perpendicular to the front-rear direction and the up-down direction. The intermediate-cover part 240 is fixed to the rearward-cover part 250. Consequently, due to the presence of the hinge 290, the forward-cover part 230 pivots and folds with respect to the intermediate-cover part 240 and the rearward-cover part 250, which are fixed relative to the connection part 31.

To ensure that the forward-cover part 230 does not interfere with the tool accessory 40 mounted on the spindle 24, the hinge 290 is configured such that the forward-cover part 230 can not pivot downward from the position at which the forward-cover part 230 is horizontal or coplanar with the intermediate-cover part 240. The hinge 290 may be configured such that it has a prescribed frictional resistance and therefore, when the forward-cover part 230 has pivoted upward, it does not move downward (or moves downward only slowly) due to gravity.

Thus, in the present embodiment, the protective cover 210 comprises the plurality of cover parts 230, 240, 250, which covers the tool accessory 40 from above. Furthermore, of the plurality of cover parts 230, 240, 250, the forward-cover part 230 positioned at a location spaced apart from the spindle 24 in the radial direction is foldably connected to the intermediate-cover part 240 by the hinge 290. Based on this configuration, the protective cover 210 is configured such that the portion that covers the forward-upper part of the tool accessory 40 can deform in the direction upward and away from the tool accessory 40.

Accordingly, in the grinder 200 according to the present embodiment, it is possible to prevent the protective cover 210 from interfering with the workpiece 50 and thus to prevent a drop in the work efficiency of the grinder 200 while still covering the entirety of the tool accessory 40 from above, the same as in the first embodiment. Accordingly, according to the present embodiment, a grinder 200 that excels in work efficiency can be provided.

As can be understood from FIG. 7, a tightening part 275 of the circular-tubular part 270, which corresponds to the tightening part 175 of the first embodiment, is disposed such that it is rotated by 60° relative to the front-rear axis of the tool, the same as in the first embodiment. This arrangement is significant from the viewpoint that, when the forward-cover part 230 has been pivoted upward, the tightening part 275 does not interfere with the forward-cover part 230. The rearward-cover part 250 and the intermediate-cover part 240 described above may be composed of monolithic sheet metal.

Third Embodiment

Figure 8:
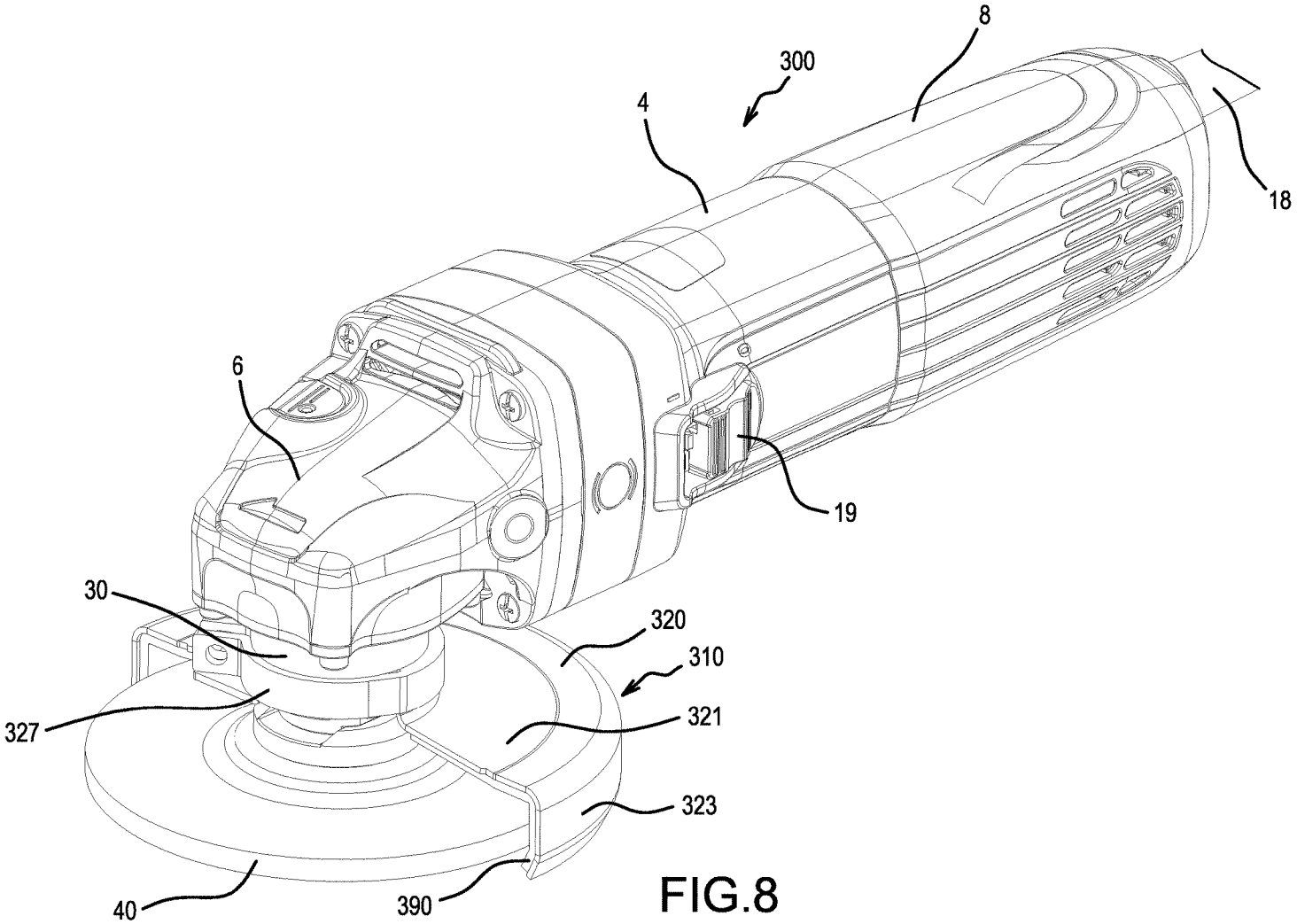
FIG. 8 is an oblique view of the grinder according to a third embodiment.
Figure 9:
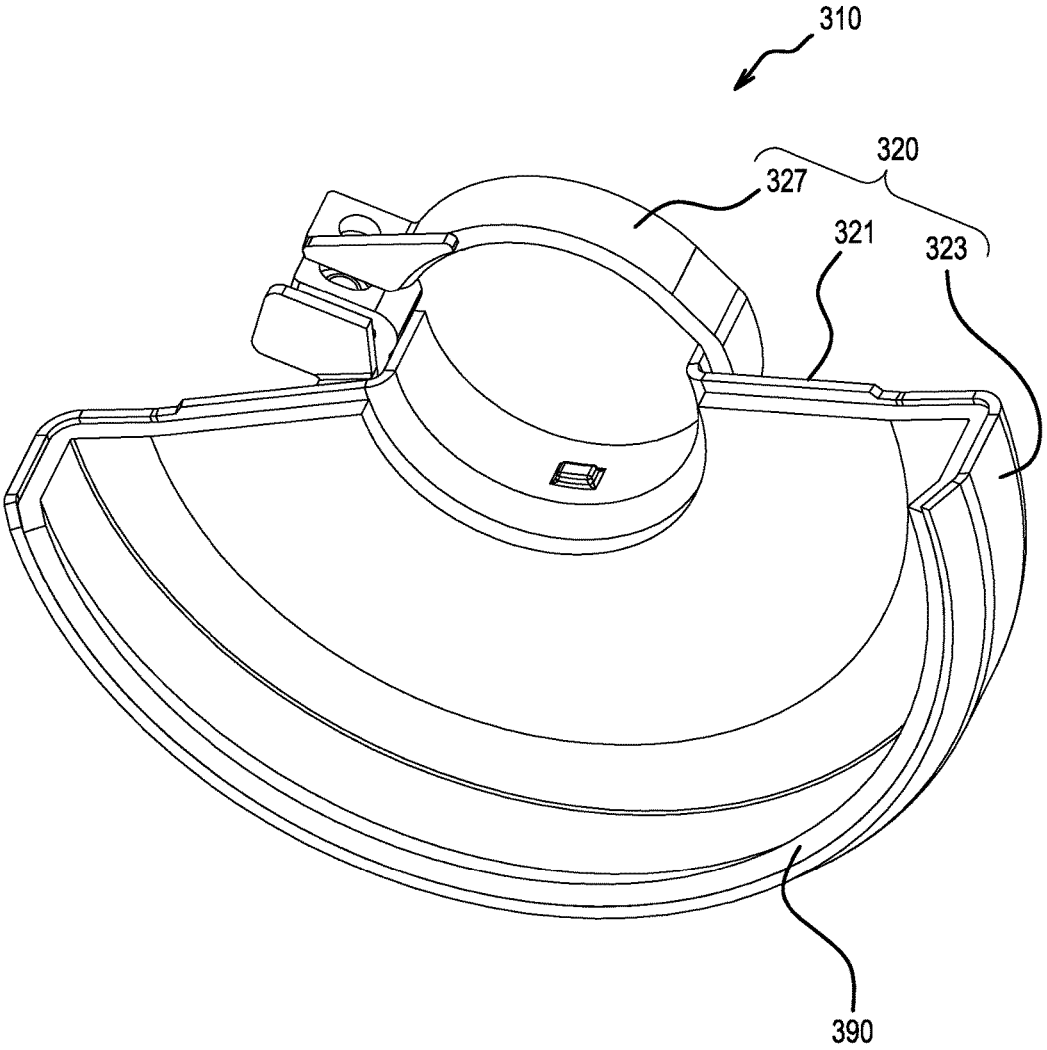
FIG. 9 is an oblique view, viewed from below, of the protective cover according to the third embodiment.
Figure 10:
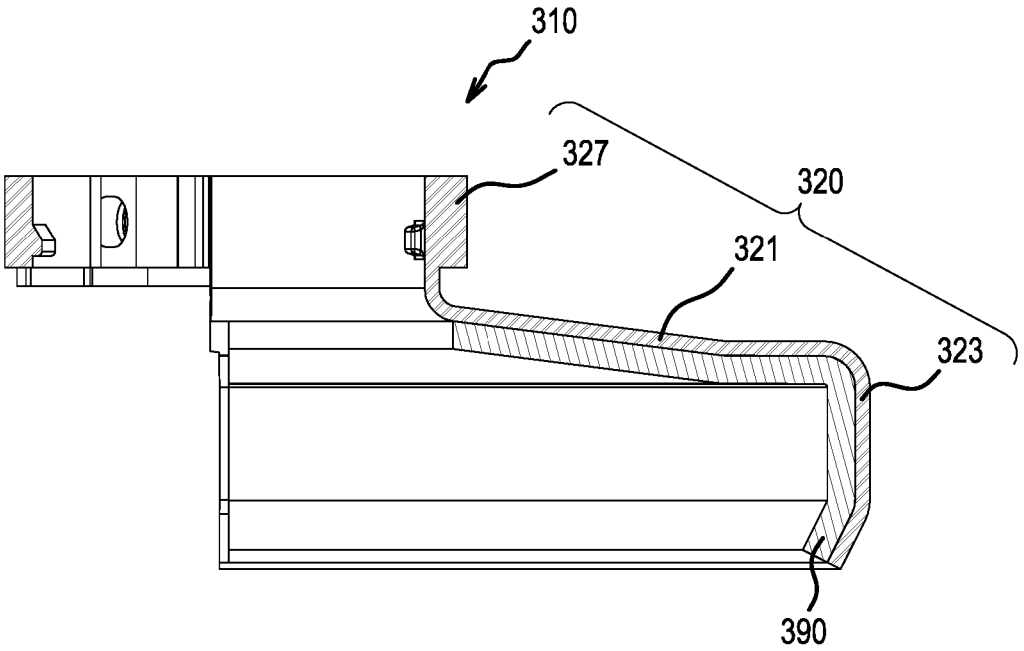
FIG. 10 is a cross-sectional view of the protective cover according to the third embodiment.

The grinder 300 according to a third embodiment is configured such that a protective cover 310 shown in FIG. 8, FIG. 9, and FIG. 10 is mounted on the grinder 1 shown in FIG. 1 or on a similar grinder.

The protective cover 310 includes a cushioning member on the inner surface of a conventional protective cover 60. That is, the protective cover 310 comprises: a cover main body 320, which corresponds to the protective cover 60 and extends in the circumferential direction of the spindle 24; and a cushioning member 390, which is affixed to an inner surface of the cover main body 320.

The cover main body 320 comprises an upper-part structure 321, a side-part structure 323, and a circular-tubular part 327, which is for fixing the protective cover 310 to the second gear housing 30. The upper-part structure 321 and the side-part structure 323 are integrally formed of a metal material.

The cushioning member 390 is thin and plate shaped and coats or covers the inner surface of the cover main body 320. The cushioning member 390 is composed of, for example, an elastic foam body or sponge that is formed using a synthetic resin, a natural rubber, or a synthetic rubber as the raw material.

The cushioning member 390 is affixed to an inner surface of the upper-part structure 321 that faces the tool accessory 40 and to an inner surface of the side-part structure 323 that faces the tool accessory 40. The cover main body 320 and the cushioning member 390 may be integrally molded from metal and rubber, respectively. For example, the rubber may be attached to the metal (e.g., steel) via a vulcanized rubber bond. As can be understood from FIG. 9 and FIG. 10, the cushioning member 390 extends substantially over the entirety of the inner surface of the upper-part structure 321 and the inner surface of the side-part structure 323.

Due to the presence of the protective cover 310, any impacts that occur when debris from the workpiece 50, the tool accessory 40, or the like flies about inside the protective cover 310 during processing work can be absorbed by the cushioning member 390.

In the present embodiment, although the cushioning member 390 is provided over substantially the entire area of the inner surface of the upper-part structure 321 and the inner surface of the side-part structure 323, the cushioning member 390 may be provided over just a portion of the areas of the inner surfaces. The cushioning member 390 can be provided over the entire surface or a portion thereof of either the upper-part structure 321 or the side-part structure 323 alone. The cushioning member 390 may be provided evenly or unevenly over the inner surfaces, e.g., with different thicknesses. An elastic and/or resilient material instead of the foam body may be used as the cushioning member 390. A representative elastic material is rubber.

Fourth Embodiment

Figure 11:
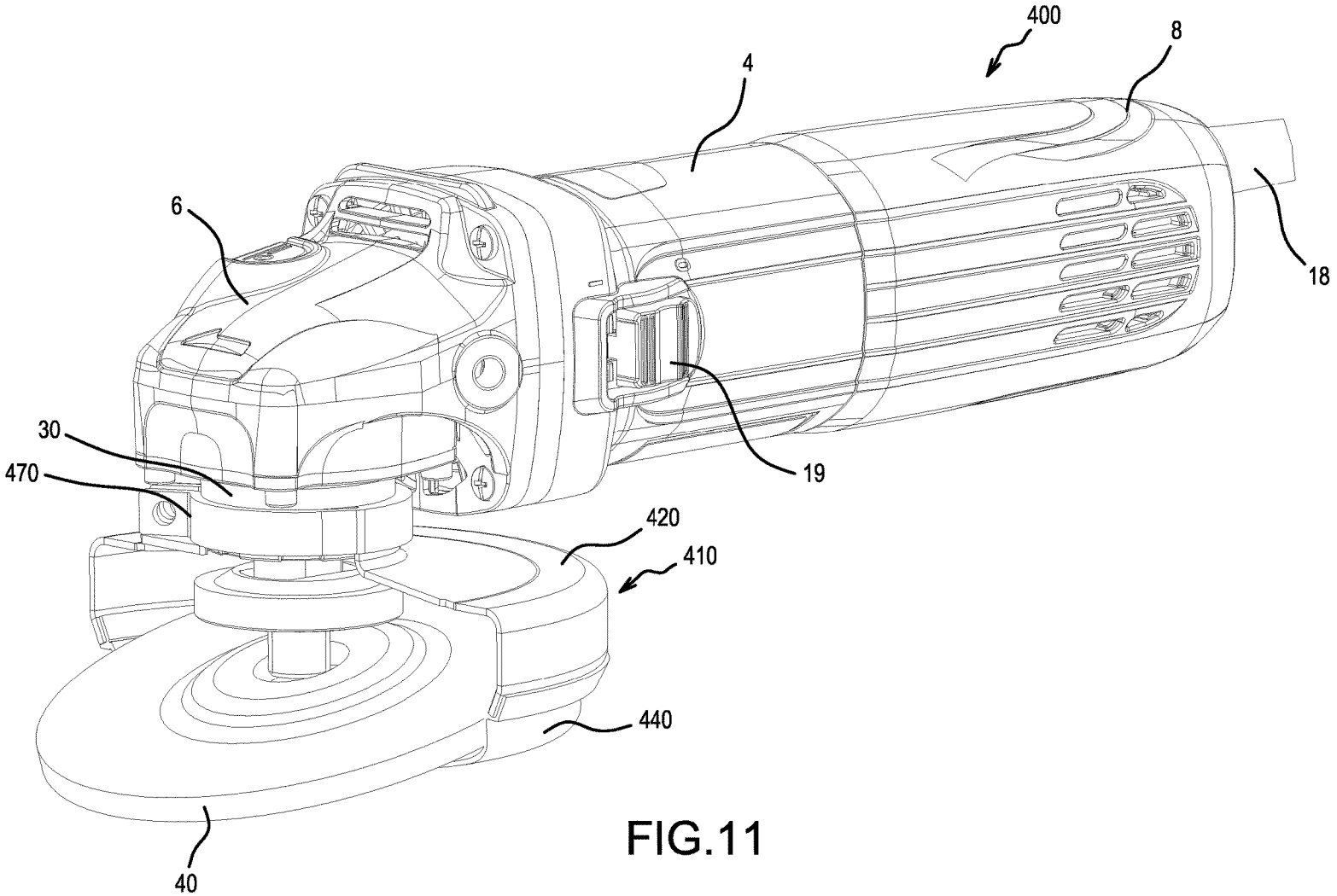
FIG. 11 is an oblique view of the grinder according to a fourth embodiment.
Figure 12:
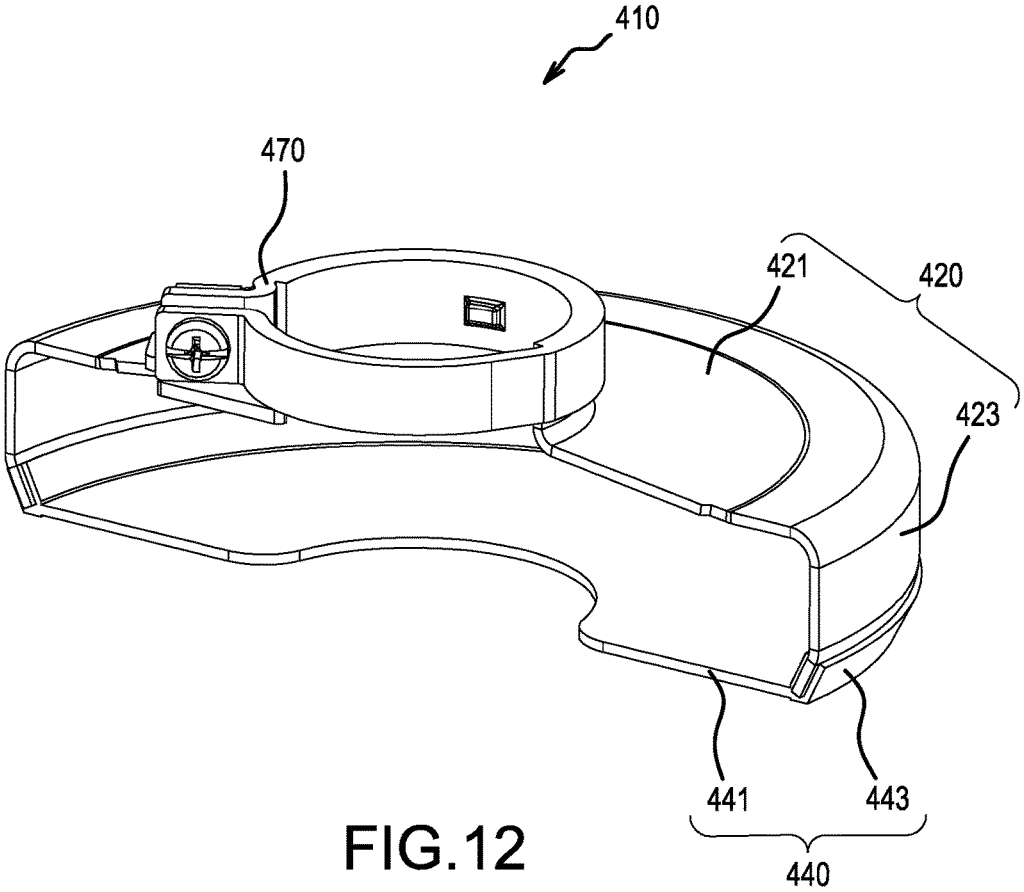
FIG. 12 is an oblique view of the protective cover according to the fourth embodiment.

The grinder 400 according to a fourth embodiment is configured such that a protective cover 410 shown in FIG. 11 and FIG. 12 is mounted on the grinder 1 shown in FIG. 1 or on a similar grinder. The protective cover 410 is a protective cover suitable for cutting work.

The protective cover 410 is configured such that it covers the tool accessory 40 from below in addition to covering it from above. Specifically, the protective cover 410 comprises an upward-cover part 420 and a downward-cover part 440. A circular-tubular part 470 for fixing the protective cover 410 to the second gear housing 30 is further provided on the upward-cover part 420. The upward-cover part 420 and the circular-tubular part 470 are configured the same as the rearward-cover part 150 and the circular-tubular part 170 that constitute the protective cover 110 of the first embodiment.

That is, the upward-cover part 420 comprises an upper-part structure 421 and a side-part structure 423, which extends downward from an outer-circumferential-end edge of the upper-part structure 421, and is configured such that it extends in the circumferential direction of the spindle 24 and covers the tool accessory 40 from above and the sides. The upper-part structure 421 and the side-part structure 423 are integrally formed of a metal material. The side-part structure 423 is configured such that its lower end is curved slightly to the inner side in the radial direction. The circular-tubular part 470 is provided on the upper-part structure 421, and the upward-cover part 420 is fixed to the second gear housing 30 by the circular-tubular part 470.

The downward-cover part 440 comprises a lower-part structure 441 and a connection part 443. The lower-part structure 441 and the connection part 443 are integrally formed of an elastic and/or resilient material, such as, e.g., rubber or a rubber-like material.

The lower-part structure 441 has a semicircular shape, the same as the upper-part structure 421, is disposed in an opening of the upward-cover part 420 that is surrounded by the lower end of the side-part structure 423, and partially closes up the upward-cover part 420 from below. That is, the lower-part structure 441 is disposed such that, below the upward-cover part 420, it covers the tool accessory 40 from below.

The connection part 443 is provided along an outer circumference of the lower-part structure 441. The connection part 443 has a hollow or groove that faces upward, and thereby the upper part of the connection part 443 has a bifurcated shape. This shape allows the connection part 443 to be connected to the side-part structure 423 by sandwiching the lower end of the side-part structure 423 of the upward-cover part 420. Specifically, the connection part 443 is fixed to the side-part structure 423 by an adhesive. Owing to this configuration, the downward-cover part 440 is fixed to the upward-cover part 420.

The downward-cover part 440 as described above is composed of a rubber material and therefore is capable of deforming as well as expanding and contracting. This expansion/contraction function is helpful in mounting the tool accessory 40 on the spindle 24 and dismounting the tool accessory 40 therefrom, as shown in FIG. 11.

Covering the tool accessory 40 from below in addition to above prevents dust from flying about. Nevertheless, exchanging the tool accessory 40 requires sufficient space below the spindle 24. Any structures located below the tool accessory 40 tend to interfere with the tool accessory 40 when the tool accessory 40 is being exchanged. This interference leads to a drop in the work efficiency in exchanging the tool accessory 40 and, in some cases, may make it impossible to mount the desired tool accessory 40 on the spindle 24.

Consequently, in the present embodiment, the downward-cover part 440 is composed of a rubber material and deforming the downward-cover part 440 makes it possible to move the downward-cover part 440 out of the way and enlarge the space below the spindle 24 to provide room (space) for exchanging the tool accessory 40. FIG. 11 shows the downward-cover part 440 pressed and thereby deformed during the work of exchanging the tool accessory 40.

That is, using the protective cover 410, it is possible to prevent interference between the downward-cover part 440 and the tool accessory 40 when exchanging the tool accessory (e.g., grinding wheel). Thus, a highly convenient grinder can be provided according to the present embodiment.

In the present embodiment, to configure the protective cover 410 such that it can deform in the direction downward of and away from the tool accessory 40, the entire downward-cover part 440 is composed of a rubber material; however the entire downward-cover part 440 does not have to be composed of a rubber material.

For example, the protective cover 410 may be configured such that just a circumferential portion the downward-cover part 440 near the spindle can deform downward. Alternatively, the downward-cover part 440 may be composed of a metal material. In that case, the connection part between the downward-cover part 440 and the upward-cover part 420 may be composed of an elastic material such that it can flex and expand and contract, and therefore it is possible to configure the protective cover 410 such that the downward-cover part 440 can be pressed downward.

In addition, in the present embodiment, although the downward-cover part 440 is fixed to the upward-cover part 420 by an adhesive, the downward-cover part 440 may instead be detachably mounted to the upward-cover part 420. From the viewpoint that it is possible to prevent debris from flying downward of the tool accessory 40, the protective cover 410 is particularly expedient in cutting work in which both a cutting stone is used and there is a possibility that the underside of the tool accessory 40 might face toward the user.

Fifth Embodiment

Figure 13:
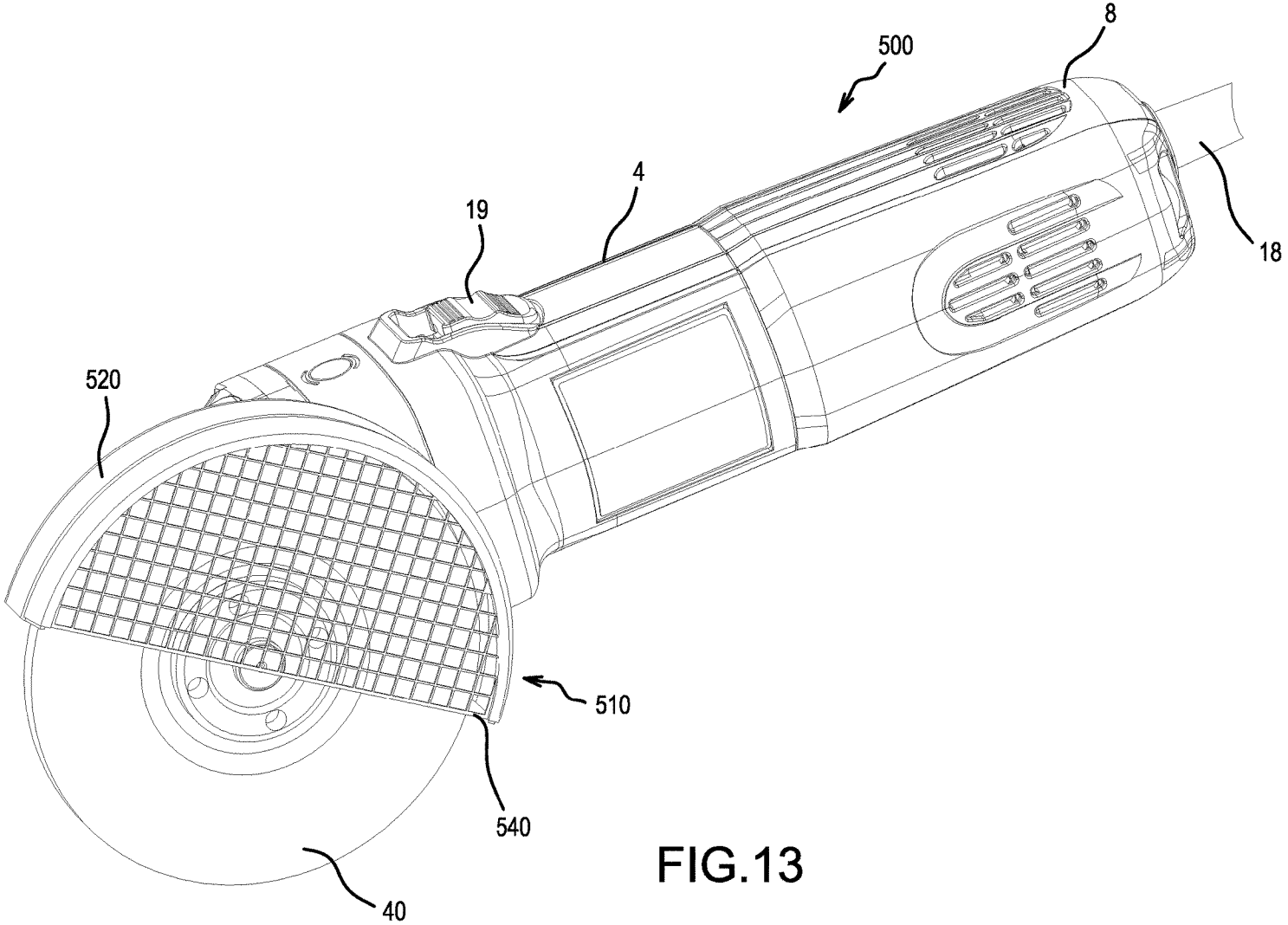
FIG. 13 is an oblique view of the grinder according to a fifth embodiment.
Figure 14:
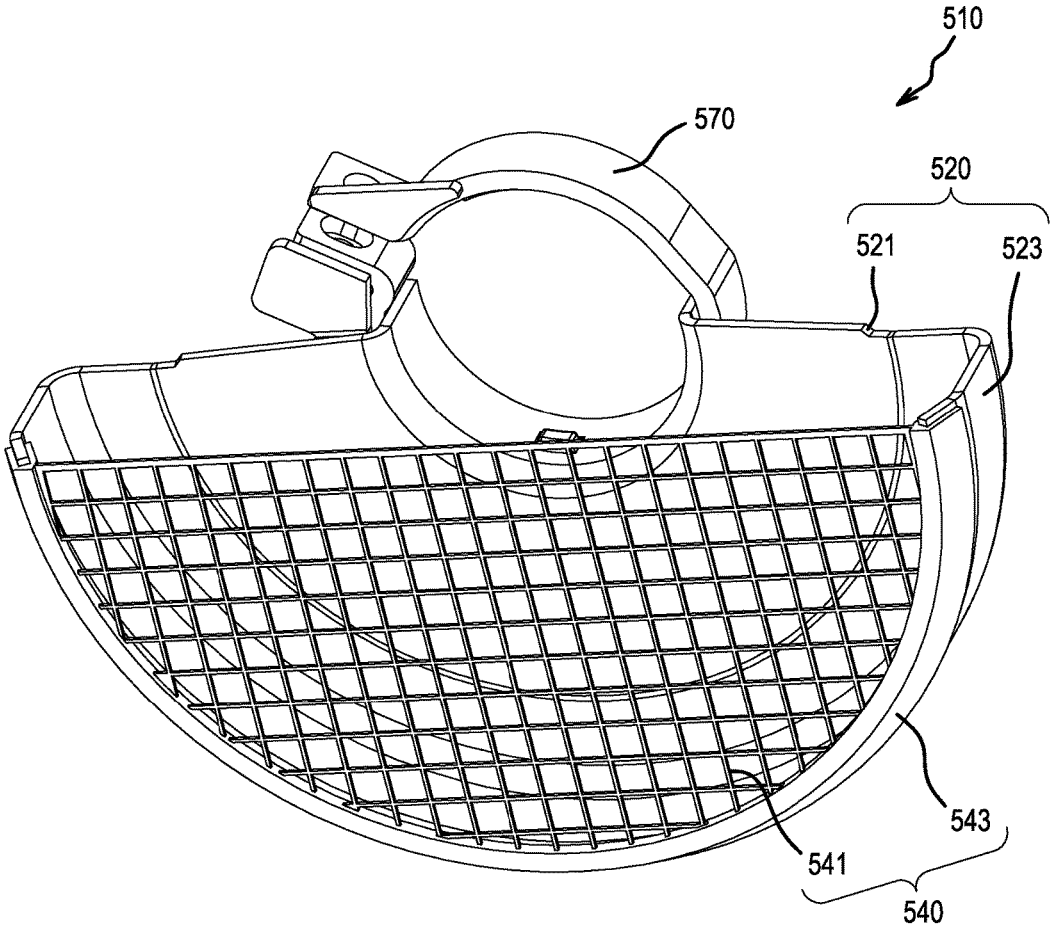
FIG. 14 is an oblique view, viewed from below, of the protective cover according to the fifth embodiment.
Figure 15:
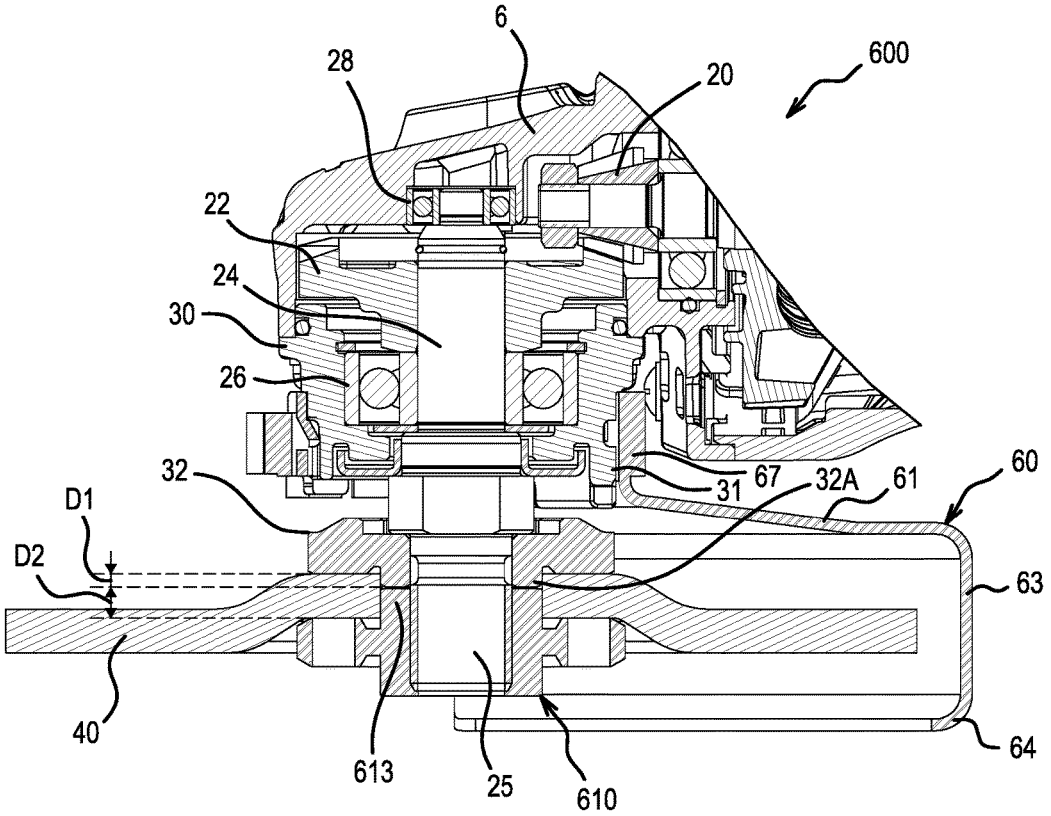
FIG. 15 is a cross-sectional view that shows the configuration surrounding the spindle in the grinder according to a sixth embodiment.
Figure 16A:
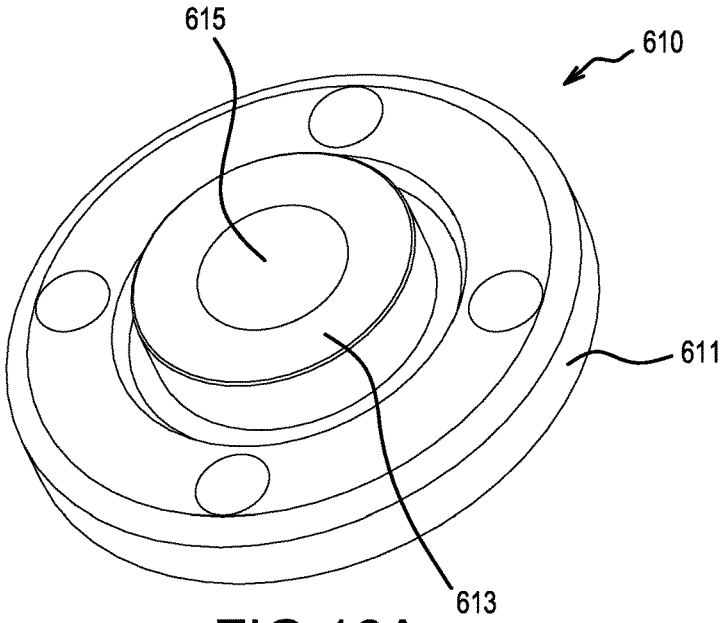
FIG. 16A is an oblique view of a lock nut according to the sixth embodiment.
Figure 16B:
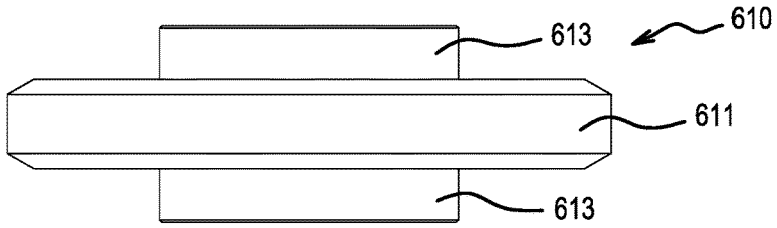
FIG. 16B is a side view of the lock nut.
Figure 16C:
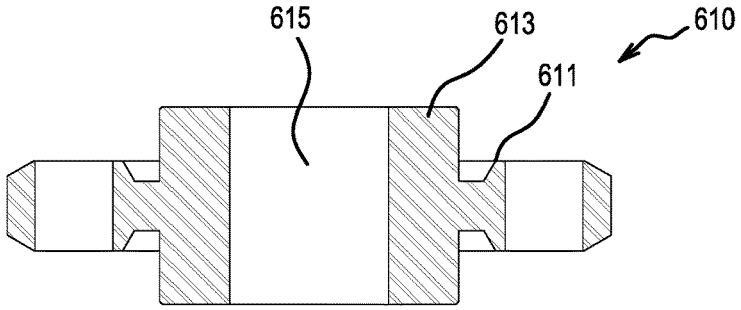
FIG. 16C is a cross-sectional view of the lock nut.

The grinder 500 according to a fifth embodiment is configured such that a protective cover 510 shown in FIG. 13 and FIG. 14 is mounted on the grinder 1 shown in FIG. 1 or on a similar grinder. In the grinder 500 shown in FIG. 13, the circumferential orientation of the protective cover 510 is adjusted to an orientation that is suited to the cutting work being performed.

In the protective cover 510, the lower-part structure 441, which corresponds to the protective cover 410 of the fourth embodiment, is configured as a mesh material that does not block the user's view of the underside of the tool accessory 40.

The protective cover 510 comprises an upward-cover part 520 and a downward-cover part 540. A circular-tubular part 570 for fixing the protective cover 510 to the second gear housing 30 is further provided on the upward-cover part 520. The upward-cover part 520 and the circular-tubular part 570 are configured the same as the rearward-cover part 150 and the circular-tubular part 170 that constitute the protective cover 110 of the first embodiment.

That is, the upward-cover part 520 comprises an upper-part structure 521 and a side-part structure 523, which extends downward from an outer-circumferential-end edge of the upper-part structure 521, and is configured such that it extends in the circumferential direction of the spindle 24 and covers the tool accessory 40 from above and the sides. The upper-part structure 521 and the side-part structure 523 are integrally formed of a metal material. A lower end of the side-part structure 523 is slightly curved to the inner side in the radial direction. The circular-tubular part 570 is provided on the upper-part structure 521, and the upward-cover part 520 is fixed to the second gear housing 30 by the function of the circular-tubular part 570.

The downward-cover part 540 comprises a lower-part structure 541 and a connection part 543. The lower-part structure 541 is composed of a mesh material made of metal, in other words, a wire mesh, and is configured as a semicircle. The mesh size is preferably selected to prevent large debris from flying through the lower-part structure 541 during processing work.

The connection part 543 is provided along the outer circumference of the lower-part structure 541 and is fixed to the lower-part structure 541. The connection part 543 is composed of, for example, a metal material and is capable of being connected to the lower-part structure 541 by welding.

Like the connection part 443, the connection part 543 has a hollow or groove that faces upward and is connected to the side-part structure 523 such that the connection part 543 sandwiches the lower end of the side-part structure 523 of the upward-cover part 520.

According to one example, the connection part 543 is fixed to the side-part structure 523 by an adhesive or by welding. According to an alternative example, the connection part 543 is detachably fixed to the side-part structure 523. By setting the width of the above-mentioned hollow or groove in the connection part 543 slightly smaller than the thickness of the lower end of the side-part structure 523, the connection part 543 pressure-contacts the side-part structure 523 when the side-part structure 523 is inserted into the above-mentioned hollow or groove, and thereby the side-part structure 523 can be fixed rigidly. Owing to this configuration, the downward-cover part 540 can be fixed to the upward-cover part 520.

During processing work, the downward-cover part 540 may be interposed between the portion of the workpiece 50 to be processed and the user's eyes. According to the present embodiment, the lower-part structure 541 is composed of a mesh material such that the user's view downward of the tool accessory 40 is not completely blocked by the downward-cover part, and consequently it is possible to prevent a drop in work efficiency in such a case.

In the present embodiment, although the lower-part structure 541 is composed of a mesh material, the lower-part structure 541 may instead be composed of a transparent resin (plastic) material. For example, the downward-cover part 540 may be configured by substituting the lower-part structure 441 of the protective cover 410 shown in FIG. 12 or the lower-part structure 541 of the protective cover 510 shown in FIG. 14 with a lower-part structure composed of the transparent resin material. By making the lower-part structure 541 from a transparent material, it also is possible to cover the underside of the tool accessory 40 such that the user's view is not blocked.

As yet another example, instead of the lower-part structure 541 being composed of a mesh material or a transparent material, the lower-part structure 541 may be provided with one or a plurality of through holes so that the user's view is not completely blocked. In addition, the protective cover 510 may comprise a connection part 543. That is, the lower-part structure 541 may be directly welded to the side-part structure 523 of the upward-cover part 520.

Sixth Embodiment

The grinder 600 according to a sixth embodiment is configured such that, instead of the lock nut 34, a lock nut 610 shown in FIG. 15 and FIGS. 16A, 16B, 16C is mounted on the grinder 1 shown in FIG. 1 or on a similar grinder.

As can be understood by comparing the lock nut 610 with the lock nut 34 shown in FIG. 2, the lock nut 610 of the present embodiment includes cylindrical bosses or pilot parts 613 that protrude from opposite surfaces of the lock nut main body 611 at locations at which they face a pilot part 32A of the inner flange 32.

A screw hole 615, which passes through the lock-nut main body 611 and the pilot parts 613, is provided in the center of the lock nut 610. The screw hole 615 is configured such that the screw part 25, which is provided on the tip of the spindle 24, can be screwed thereto.

The conventional lock nut 34 comprises a protruding pilot part 34A on only a first surface of the lock-nut main body, and a protruding pilot part is not provided on a second surface on the opposite side of the lock-nut main body.

The first surface is configured such that, because it includes the protruding pilot part 34A, when the lock nut 34 is mounted on the screw part 25 at the tip of the spindle 24 such that the first surface opposes the inner flange 32, a space that corresponds to the thickness of the grinding stone is formed between the lock nut 34 and the inner flange 32. Therefore, the grinding stone (grinding wheel), which is one example of the tool accessory 40, can be appropriately held between the lock nut 34 and the inner flange 32.

The second surface is configured such that, by virtue of not being provided with a protruding pilot part, when the lock nut 34 is mounted on the screw part 25 at the tip of the spindle 24 such that the second surface opposes the inner flange 32, a space that corresponds to the thickness of the cutting stone is formed between the lock nut 34 and the inner flange 32. Therefore, the cutting stone (cutting wheel) can be appropriately held between the lock nut 34 and the inner flange 32. In other words, either a grinding stone or a cutting stone can be connected to the spindle 24 using the same lock nut 34 merely by reversing the orientation of the lock nut 34.

However, when the lock nut 34 of this type is mounted on the grinder 1, the cutting stone, which serves as the tool accessory 40, can be mounted on the spindle 24 with the protective cover 60 for grinding work mounted as is. In other words, a user might be tempted to replace a grinding stone with a cutting stone without using a protective cover that is suitable for cutting work.

If the cutting stone as described above is used, then the tool accessory 40 is disposed perpendicular to the workpiece 50, and the state arises in which the workpiece 50 is processed using the side edge of the tool accessory 40. In this state, there is a possibility that the underside of the tool accessory 40 will face toward the user. Accordingly, the protective cover for cutting work that covers the tool accessory 40 from below is preferably mounted on the grinder 1. Nevertheless, there is a possibility that, because it is labor-intensive to exchange the protective cover, the user will merely exchange the tool accessory 40 for the cutting stone without exchanging the protective cover 60 for grinding work, which is already mounted, with the protective cover for cutting work.

Accordingly, the lock nut 610 of the present embodiment is configured such that the same structure of the first surface of the conventional lock nut 34 is provided on both the first surface and the second surface.

The lock nut 610 is configured such that, in the state in which the lock nut 610 is disposed downward of the inner flange 32 via the screw part 25 such that the pilot part 32A of the inner flange 32 and its pilot part 613 contact one another, a space that corresponds to the thickness of the grinding stone is formed between the lock nut 610 and the inner flange 32.

That is, the lock nut 610 is configured such that an amount-of-protrusion D2 of the pilot part 613 is set so that a total DS (D1+D2) of an amount-of-protrusion D1 of the pilot part 32A of the inner flange 32 and an amount-of-protrusion D2 of the pilot part 613 of the lock nut 610 corresponds to the thickness of the grinding stone.

The thickness of the grinding stone in the up-down direction is generally approximately 6 mm. Accordingly, the total DS can be set to a value of, for example, 6 mm or a value smaller than that. The thickness of the cutting stone in the up-down direction is usually significantly smaller than the grinding stone, and is less than 2 mm. Accordingly, according to the lock nut 610 in which the pilot parts 613 designed such that the total DS is greater than 2 mm is provided on both surfaces, the cutting stone cannot be fixed to the spindle 24 using the lock nut 610 regardless of which surface is disposed facing the inner flange 32.

That is, even in the state in which the inner flange 32 and the lock nut 610 are most proximate to one another, an extensive space greater than the thickness of the cutting stone in the up-down direction is formed between the inner flange 32 and the lock nut 610. Accordingly, the lock nut 610 can not fix the cutting stone to the spindle 24. Consequently, the user essentially cannot usably mount the cutting stone on the spindle 24 using the lock nut 610.

Thus, according to the present embodiment, by providing the lock nut 610, which has a shape specialized for the grinding stone, on both the protective cover 60 for grinding work and the grinder 600, the cutting stone essentially cannot be used with the grinder 600. Accordingly, according to the present embodiment, by mounting the cutting stone on the grinder 600 having the protective cover 60 for grinding work, it is possible to prevent the protective value of having the protective cover 60 from being diminished.

The possibility that the user will mount the cutting stone on the grinder 600 using the conventional lock nut 34 can be prevented by an administrator managing the lock nuts 34, 610.

Seventh Embodiment

Figure 17:
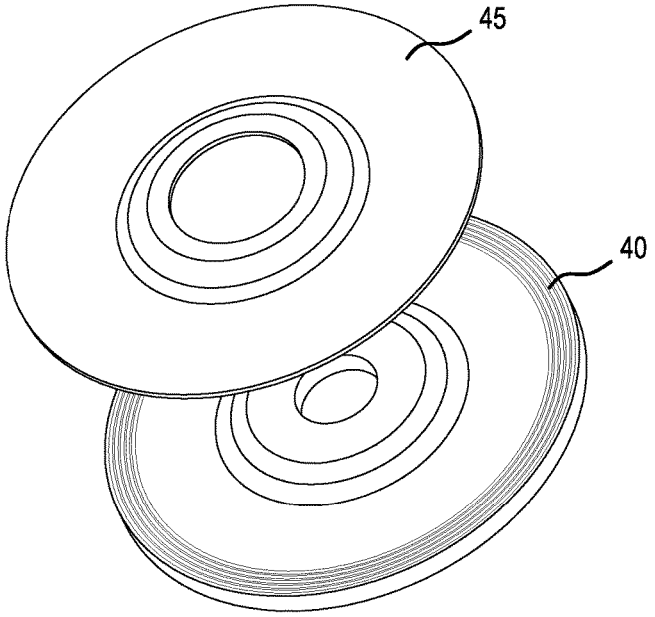
FIG. 17 is an oblique view of a tool accessory and an adhesive sheet prior to the affixing of the adhesive sheet to the tool accessory.
Figure 18:
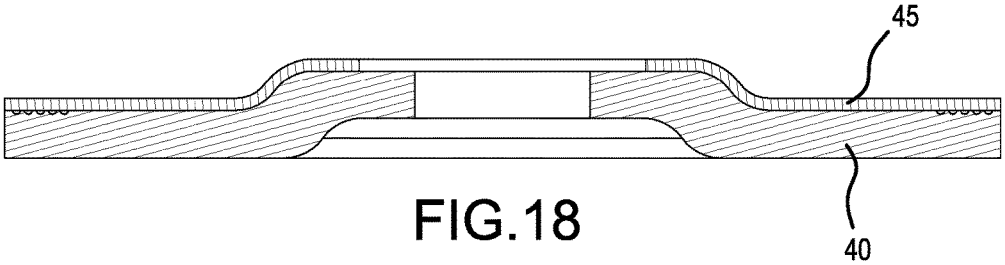
FIG. 18 is a cross-sectional view of the tool accessory and the adhesive sheet after the adhesive sheet has been affixed to the tool accessory.

In the tool accessory 40 according to the present embodiment, as shown in FIG. 17 and FIG. 18, an adhesive sheet 45 having a shape that corresponds to the upper surface of the tool accessory 40 is affixed to the upper surface of the tool accessory 40, which is not the processing surface. FIG. 17 shows the tool accessory 40 and the adhesive sheet 45 prior to the adhesive sheet 45 being affixed to the tool accessory 40, and FIG. 18 shows a cross section of the tool accessory 40 after the adhesive sheet 45 has been affixed to the tool accessory 40.

Affixing the adhesive sheet 45 to the tool accessory 40, helps prevent debris from flying away from the spindle 24 if the tool accessory 40 breaks due to fatigue. In order to prevent such flying debris, the adhesive sheet 45 is preferably composed of a high-strength resin sheet.

Other Embodiments

The first embodiment to the seventh embodiment are explained above, but the grinder, the cover, and the lock nut of the present disclosure are not limited to the above-mentioned embodiments, and various other embodiments can be adopted. These other embodiments include, but are not limited to:

1. A grinder comprising: a motor; a housing that houses the motor; a spindle that protrudes downward from the housing, is driven by the motor, and thereby rotates; a cover that is provided on the spindle in the circumferential direction and at least partially covers the tool accessory, which is mounted on the spindle; and an elastic material that extends to at least one part of the surface of the cover that faces the tool accessory.

2. A grinder comprising: a motor; a housing that houses the motor; a spindle that protrudes downward from the housing, is driven by the motor, and thereby rotates; and a cover that is provided on the spindle in the circumferential direction and at least partially covers the tool accessory, which is mounted on the spindle, from above and below; wherein the cover is configured such that a portion composed of an elastic material and that covers the tool accessory from below at least partially deforms, by the deformation of the elastic material, in a direction downward from and away from the tool accessory.

3. A grinder comprising: a motor; a housing that houses the motor; a spindle that protrudes downward from the housing, is driven by the motor, and thereby rotates; and a cover that is provided on the spindle in the circumferential direction and at least partially covers the tool accessory, which is mounted on the spindle; wherein the cover comprises: a first cover part that is provided on the spindle in the circumferential direction and at least partially covers the tool accessory from above; and a second cover part that is fixed to the first cover part and at least partially covers the tool accessory from below; and at least one portion of the second cover part is composed of an elastic material.

4. A grinder comprising: a motor; a housing that houses the motor; a spindle that protrudes downward from the housing, is driven by the motor, and thereby rotates; and a cover that is provided on the spindle in the circumferential direction and at least partially covers the tool accessory, which is mounted on the spindle; wherein the cover comprises: a first cover part that is provided on the spindle in the circumferential direction and at least partially covers the tool accessory from above; and a second cover part that is fixed to the first cover part and at least partially covers the tool accessory from below; and at least one portion of the second cover part is configured such that a user's view is not blocked.

5. A grinder according to the above-described embodiment 4, wherein the at least one portion of the second cover part is composed of a transparent material or a mesh material.

6. A grinder comprising: a motor; a housing that houses the motor; a spindle that protrudes downward from the housing, is driven by the motor, and thereby rotates; an inner flange that is provided on a tip part of the spindle; a lock nut that is disposed downward of the inner flange via a tool accessory and fixes the tool accessory between the lock nut and the inner flange; and a cover for grinding that is provided on the spindle in the circumferential direction and at least partially covers the tool accessory, which is mounted on the spindle, from above; wherein: the lock nut has, on both surfaces, a pilot part that forms, between the inner flange and the lock nut, a space that corresponds to the thickness of the tool accessory for grinding, and the protruding pilot part faces the inner flange.

7. A cover that is provided on a spindle, which constitutes a grinder and protrudes downward, in a circumferential direction and at least partially covers a tool accessory, which is mounted on the spindle, from above, wherein: a structure is provided in which at least one part of the cover deforms in a direction away from the tool accessory.

8. A cover that is provided on a spindle, which constitutes a grinder and protrudes downward, in a circumferential direction and at least partially covers a tool accessory, which is mounted on the spindle, from above, comprising: an elastic material; wherein the cover is configured such that at least one part thereof deforms, due to the deformation of the elastic material, in a direction away from the tool accessory.

9. A cover that is provided on a spindle, which constitutes a grinder and protrudes downward, in a circumferential direction and at least partially covers a tool accessory, which is mounted on the spindle, from above, comprising: at least a first cover part and a second cover part that at least partially cover the tool accessory from above; wherein the first cover part is foldably connected to the second cover part at a location that is farther spaced apart from the spindle in the radial direction than is the second cover part; and the cover is configured such that it deforms, by the folding, in the direction away from the tool accessory.

10. A cover that is provided on a spindle, which constitutes a grinder and protrudes downward, in a circumferential direction and at least partially covers a tool accessory, which is mounted on the spindle, wherein: the cover is configured such that, owing to an elastic material, the tool accessory is at least partially covered.

11. A cover that is provided on a spindle, which constitutes a grinder and protrudes downward, in a circumferential direction and at least partially covers a tool accessory, which is mounted on the spindle, from above, comprising: a plurality of angular areas along the circumferential direction, wherein each angular area is composed of a raw material different from that of its adjacent area; and at least one of the plurality of angular areas is composed of an elastic material.

12. The cover according to the above-described embodiment 11, wherein the plurality of angular areas comprises: a first semicircular area composed of an elastic material and a second semicircular area composed of a metal material.

13. A cover that is provided on a spindle, which constitutes a grinder and protrudes downward, in a circumferential direction and at least partially covers a tool accessory, which is mounted on the spindle, comprising: an elastic material that extends to at least one part of a surface that faces the tool accessory.

14. A cover that is provided on a spindle, which constitutes a grinder and protrudes downward, in a circumferential direction and at least partially covers a tool accessory, which is mounted on the spindle, from above and below, comprising: an elastic material; wherein a portion that covers the tool accessory from below is configured such that it at least partially deforms, due to deformation of the elastic material, in a direction downward and away from the tool accessory.

15. A cover that is provided on a spindle, which constitutes a grinder and protrudes downward, in a circumferential direction and at least partially covers a tool accessory, which is mounted on the spindle, comprising: a first cover part that is provided on the spindle in the circumferential direction and at least partially covers the tool accessory from above; and a second cover part that is fixed to the first cover part and at least partially covers the tool accessory from below; wherein at least one portion of the second cover part is composed of an elastic material.

16. A cover that is provided on a spindle, which constitutes a grinder and protrudes downward, in a circumferential direction and at least partially covers a tool accessory, which is mounted on the spindle, comprising: a first cover part that is provided on the spindle in the circumferential direction and at least partially covers the tool accessory from above; and a second cover part that is fixed to the first cover part and at least partially covers the tool accessory from below; wherein at least one portion of the second cover part is configured such that a user's view below the tool accessory is not blocked.

17. A cover according to the above-described embodiment 24, wherein the at least one portion of the second cover part is composed of a transparent material or a mesh material.

18. A lock nut, which is provided on a tip part of a spindle constituting a grinder and protruding downward, that is disposed downward of an inner flange, a tool accessory being interposed between the lock nut and the inner flange, and fixes the tool accessory between the lock nut and the inner flange, wherein: the lock nut has, on both surfaces, a pilot part that forms, between the inner flange and the lock nut, a space that corresponds to the thickness of the tool accessory for grinding, and the protruding pilot part faces the inner flange.

A function possessed by one structural element in the above-mentioned embodiments may be provided such that it is distributed among multiple structural elements. A function possessed by multiple structural elements may be integrated in one structural element. Some of the structural elements in the above-mentioned embodiments may be omitted. At least some of the structural elements in the above-mentioned embodiments may be added to or replaced by structural elements in other embodiments mentioned above. Any aspect that is included in the technical concepts specified based on the text of the claims is an embodiment of the present invention.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved grinders and covers therefor.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

REFERENCE NUMBER LIST

1 Grinder
4 Motor housing
6 First gear housing
8 Rear cover
12 Motor
14 Rotary shaft
20 First bevel gear
22 Second bevel gear
24 Spindle
25 Screw part
26 Bearing
28 Bearing
30 Second gear housing
31 Cover-connection part
32 Inner flange
32A Pilot part
34 Lock nut
34A Pilot part
40 Tool accessory
60 Protective cover
61 Upper-part structure
63 Side-part structure
64 Curved part
67 Circular-tubular part
100 Grinder
110 Protective cover
130 Forward-cover part
131 Upper-part structure
133 Side-part structure
135 Slope
150 Rearward-cover part
151 Upper-part structure
153 Side-part structure
154 Curved part
170 Circular-tubular part
175 Tightening part
200 Grinder
210 Protective cover
230 Forward-cover part
240 Intermediate-cover part
250 Rearward-cover part
270 Circular-tubular part
275 Tightening part
290 Hinge
300 Grinder
310 Protective cover

320 Cover main body
321 Upper-part structure
323 Side-part structure
327 Circular-tubular part
390 Cushioning member
400 Grinder
410 Protective cover
420 Upward-cover part
421 Upper-part structure
423 Side-part structure
440 Downward-cover part
441 Lower-part structure
443 Connection part
470 Circular-tubular part
500 Grinder
510 Protective cover
520 Upward-cover part
521 Upper-part structure
523 Side-part structure
540 Downward-cover part
541 Lower-part structure
543 Connection part
570 Circular-tubular part
600 Grinder
610 Lock nut
611 Lock-nut main body
613 Pilot part
615 Screw hole

The invention claimed is:

1. A grinder, comprising:

a motor;

a housing that houses the motor;

a spindle that protrudes downward from a front portion of the housing and is configured to be driven by the motor;

a tool accessory mounted on the spindle and having a top and a bottom; and a cover that is provided on the spindle in the circumferential direction and at least partially covers the tool accessory from above, the cover having a front portion formed from a first material, the front portion having a top wall and a side wall depending from the top wall, the side wall having a first height and a bottom edge, an interior surface of the side wall defining an interior of the front portion of the cover, the cover further including a rear portion formed from a second material that is more rigid than the first material, the rear portion having a top wall and a side wall depending from the top wall, the side wall of the rear portion having a second height and a bottom edge;

wherein the top wall of the front portion is configured to elastically shift between a first configuration, in which a point on the bottom edge of the side wall of the front portion lies below the top of the tool accessory, and a second configuration, in which the point on the bottom edge of the side wall lies above the top of the tool accessory, by flexing the first material of the top wall of the front portion along a strip of the first material spanning the cover from a first location at the side wall of the front portion to a second location at the side wall of the front portion, the strip overlying the interior of the front portion of the cover; and the top wall of the front portion of the cover is flexible along at least two different flexing lines to elastically shift between the first configuration and the second configuration.

2. The grinder according to claim 1, wherein the top wall of the front portion of the cover is formed from a material having a Young's modulus of equal to or less than 0.5 GPa.

3. The grinder according to claim 1, wherein the top wall of the front portion of the cover is formed from a material having a Young's modulus of equal to or less than 0.05 GPa.

4. The grinder according to claim 1, wherein the point on the bottom edge of the side wall of the front portion lies below the bottom of the tool accessory when the top wall of the front portion is in the first configuration.

5. The grinder according to claim 4, wherein the first material is rubber or an elastomer.

6. The grinder according to claim 5, wherein the second material is metal.

7. The grinder according to claim 1, wherein the point on the bottom edge of the side wall of the front portion lies at or above the top wall of the front portion in the second configuration.

8. The grinder according to claim 1, wherein the first height is less than the second height.

9. The grinder according to claim 8, including a sloped wall connecting the top wall of the front portion of the cover to the top wall of the rear portion of the cover.

10. A grinder, comprising:

a motor;

a housing that houses the motor;

a spindle that protrudes downward from a front portion of the housing and is configured to be driven by the motor and to support a tool accessory for rotation with the spindle; and a cover that is provided on the spindle in the circumferential direction, the cover having a front portion formed from a first material, the front portion having a top wall lying in a plane and a side wall depending from the top wall, the side wall having a bottom edge and a first height, an interior surface of the side wall defining an interior of the front portion of the cover, the cover further including a rear portion formed from a second material that is more rigid than the first material, the rear portion having a top wall and a side wall depending from the top wall of the rear portion, the side wall of the rear portion having a bottom edge and a second height;

wherein the top wall of the front portion is configured to elastically shift between a first configuration, in which a point on the bottom edge of the side wall of the front portion lies below the plane, and a second configuration, in which the point on the bottom edge of the side wall lies at or above the plane, by flexing the first material of the top wall of the front portion along a strip of the first material spanning the cover from a first location at the side wall of the front portion to a second location at the side wall of the front portion, the strip overlying the interior of the front portion of the cover; and the top wall of the front portion of the cover is flexible along at least two different flexing lines to elastically shift between the first configuration and the second configuration.

11. The grinder according to claim 10, wherein:

the first material is rubber or an elastomer and the second material is metal.

12. The grinder according to claim 11, wherein the first height is less than the second height.

13. The grinder according to claim 10, wherein the first height is less than the second height.

14. The grinder according to claim 13, including a sloped wall connecting the top wall of the front portion of the cover to the top wall of the rear portion of the cover.

15. The grinder according to claim 10, including the tool accessory, the tool accessory having a top and a bottom, wherein when the top wall of the front portion is in the first configuration, the point on the bottom edge of the side wall of the front portion of the cover lies below the top of the tool accessory.

16. A grinder, comprising:

a motor;

a housing that houses the motor;

a spindle that protrudes downward from a front portion of the housing and is configured to be driven by the motor and to support a tool accessory for rotation with the spindle; and a cover that is provided on the spindle in the circumferential direction, the cover having a front portion formed from a first material, the front portion having a top wall lying in a plane and a side wall depending from the top wall, the side wall having a first height and a bottom edge, an interior surface of the side wall defining an interior of the front portion of the cover, the cover further including a rear portion formed from a second material that is more rigid than the first material, the rear portion having a top wall and a side wall depending from the top wall of the rear portion, the side wall of the rear portion having a second height and a bottom edge;

wherein the first height is less than the second height;

wherein the top wall of the front portion is configured to shift between a first configuration and a second configuration by flexing the first material of the top wall of the front portion along a strip of the first material spanning the cover from a first location at the side wall of the front portion to a second location at the side wall of the front portion, the strip overlying the interior of the front portion of the cover; and wherein the top wall of the front portion of the cover is flexible along at least two different flexing lines to elastically shift between the first configuration and the second configuration.

17. The grinder according to claim 16, wherein:

the first material is rubber or an elastomer and the second material is metal.

18. The grinder according to claim 16, including a sloped wall connecting the top wall of the front portion of the cover to the top wall of the rear portion of the cover.

19. The grinder according to claim 16, wherein the side wall of the front portion and the side wall of the rear portion together form a substantially continuous cylindrical wall around the spindle.

* * * * *